US010733855B2

(12) United States Patent
Loderer et al.

(10) Patent No.: US 10,733,855 B2
(45) Date of Patent: Aug. 4, 2020

(54) DEVICE, SYSTEM AND METHOD FOR STORING ITEMS

(71) Applicant: ZIPPSAFE AG, Glattbrugg (CH)

(72) Inventors: Carlo Emilio Loderer, Zurich (CH); David Ballagi-Pordany, Zurich (CH)

(73) Assignee: ZIPPSAFE AG, Glattbrugg (CH)

( * ) Notice: Subject to any disclaimer, the term of this patent is extended or adjusted under 35 U.S.C. 154(b) by 0 days.

(21) Appl. No.: 15/769,076

(22) PCT Filed: Oct. 28, 2016

(86) PCT No.: PCT/EP2016/076058

§ 371 (c)(1),
(2) Date: Apr. 18, 2018

(87) PCT Pub. No.: WO2014/072291

PCT Pub. Date: May 4, 2017

(65) Prior Publication Data

US 2018/0301005 A1 Oct. 18, 2018

Related U.S. Application Data

(60) Provisional application No. 62/247,404, filed on Oct. 28, 2015.

(51) Int. Cl.
*A47G 25/14* (2006.01)
*G08B 13/12* (2006.01)
(Continued)

(52) U.S. Cl.
CPC ..... *G08B 13/126* (2013.01); *A47G 25/145* (2013.01); *E05B 69/00* (2013.01);
(Continued)

(58) Field of Classification Search
CPC ..... E05B 69/00; E05B 69/02; E05B 69/006; A47B 61/003; A47B 25/14; A47B 25/1407; A47B 25/145
See application file for complete search history.

(56) References Cited

U.S. PATENT DOCUMENTS 1,615,430 A * 1/1927 Woodruff ..... A47G 25/54 190/14
4,244,086 A 1/1981 Gregg
(Continued)

FOREIGN PATENT DOCUMENTS

CN 2160134 Y 3/1994
CN 2674918 Y 3/1994
(Continued)

OTHER PUBLICATIONS

International Search Report in parent PCT application PCT/EP2016/076058, dated May 15, 2017, 23 pages.

*Primary Examiner* — Benyam Haile
(74) *Attorney, Agent, or Firm* — Nathan & Associates; Menachem Nathan

(57) ABSTRACT

An item storage device for securely storing items comprising: a receptacle defining a storage area for receiving an item to be stored; a fastener for opening and closing the receptacle and which operably cooperates with a lock mechanism for selectively securing the fastener in a closed position and for unsecuring the fastener for allowing the fastener to be set from the closed into an open position; and an alarm system which is operably coupled with the receptacle and which may be armed when the fastener is secured, the armed alarm system providing an output responsive to detecting that the structural integrity of the receptacle is compromised.

13 Claims, 30 Drawing Sheets

(51) Int. Cl.

| | |
|---|---|
| ***E05G 1/00*** | (2006.01) |
| ***E05G 1/08*** | (2006.01) |
| ***E05B 69/00*** | (2006.01) |
| ***E05G 1/10*** | (2006.01) |
| *G08B 25/00* | (2006.01) |

(52) U.S. Cl.

CPC ..... *E05B 69/006* (2013.01); *E05G 1/005* (2013.01); *E05G 1/08* (2013.01); *E05G 1/10* (2013.01); *G08B 25/008* (2013.01)

(56) References Cited

U.S. PATENT DOCUMENTS

| | | | | |
|---|---|---|---|---|
| 4,438,844 | A | 3/1984 | Kesselman et al. | |
| 4,540,092 | A | 9/1985 | Desantis | |
| 5,025,963 | A | 6/1991 | Goldfarb et al. | |
| 5,347,833 | A | 9/1994 | Branscum | |
| 5,927,110 | A | 7/1999 | Yu | |
| 6,202,455 | B1 | 3/2001 | Su | |
| 7,086,255 | B2 | 8/2006 | Reason | |
| 8,161,778 | B1 | 4/2012 | Ma | |
| 8,646,855 | B2 * | 2/2014 | Rahilly | A47B 61/02 211/94.01 |
| 9,864,885 | B2 | 1/2018 | William et al. | |
| 2014/0014009 | A1 * | 1/2014 | Crockwell | E05G 1/06 109/53 |
| 2014/0284232 | A1 | 9/2014 | Feris | |
| 2016/0316861 | A1 | 11/2016 | Nadine et al. | |

FOREIGN PATENT DOCUMENTS

| | | | | |
|---|---|---|---|---|
| CN | 2194101 | Y | 4/1995 | |
| DE | 102014115437 | A1 | 4/2016 | |
| EP | 1961902 | A1 | 8/2008 | |
| GB | 2462725 | A * | 2/2010 | A45C 13/24 |
| GB | 2462725 | A | 2/2010 | |
| GB | 2469827 | A | 11/2010 | |
| WO | 2002103143 | A1 | 12/2002 | |
| WO | 2009018591 | A1 | 5/2009 | |
| WO | 2011070064 | A1 | 6/2011 | |

* cited by examiner

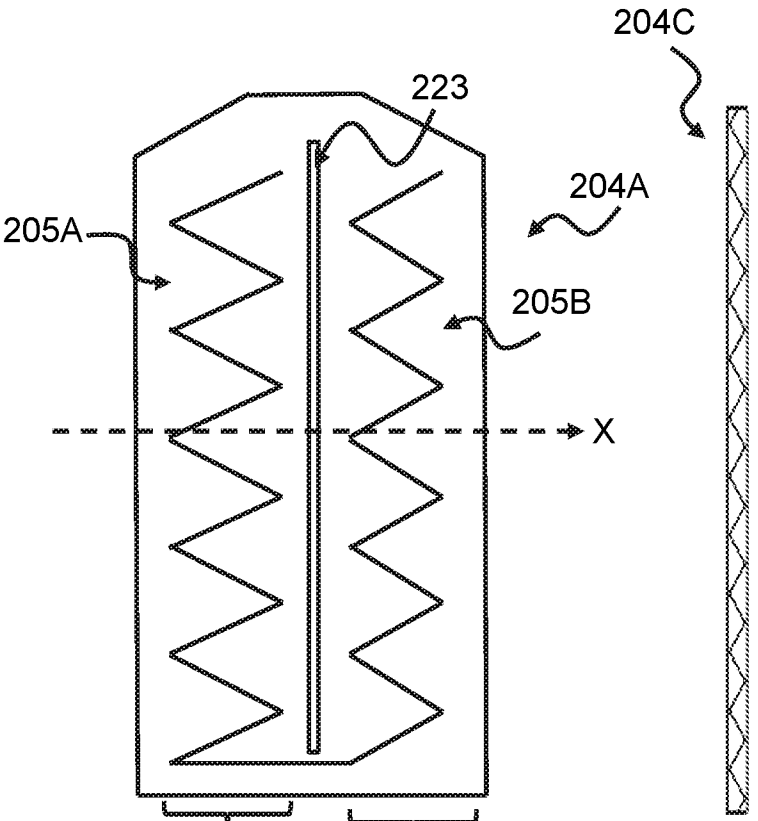
FIG. 12G
FIG. 12F
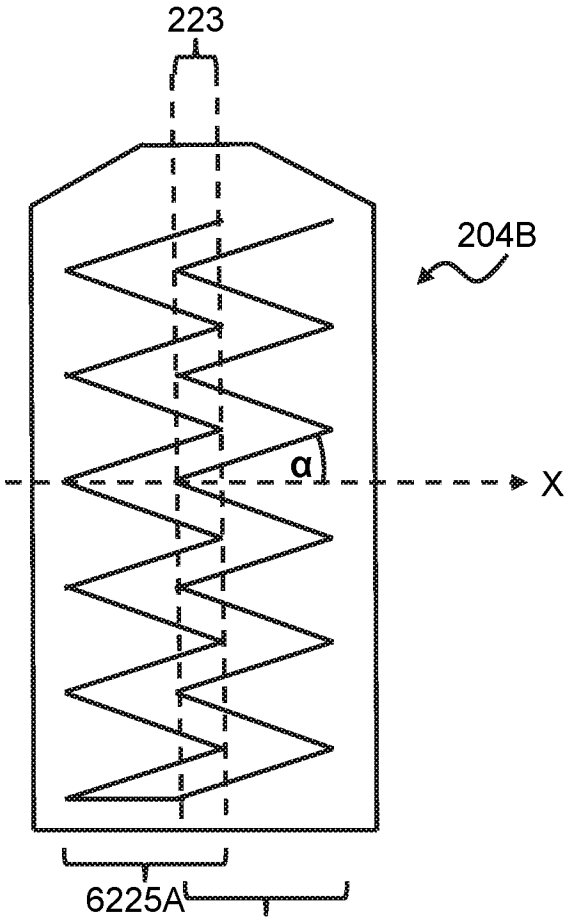
FIG. 12E

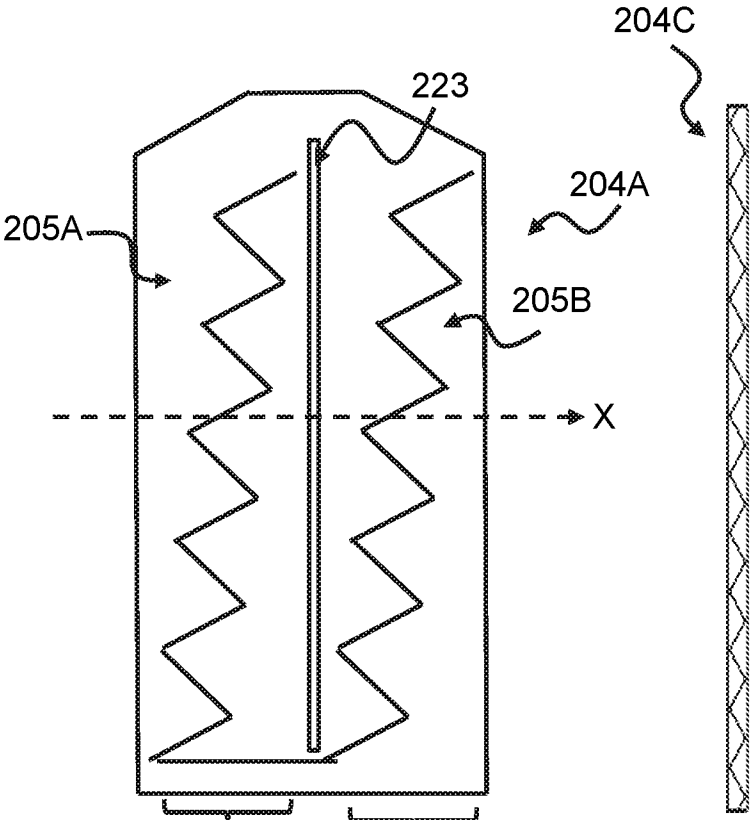
FIG. 12J
FIG. 12I
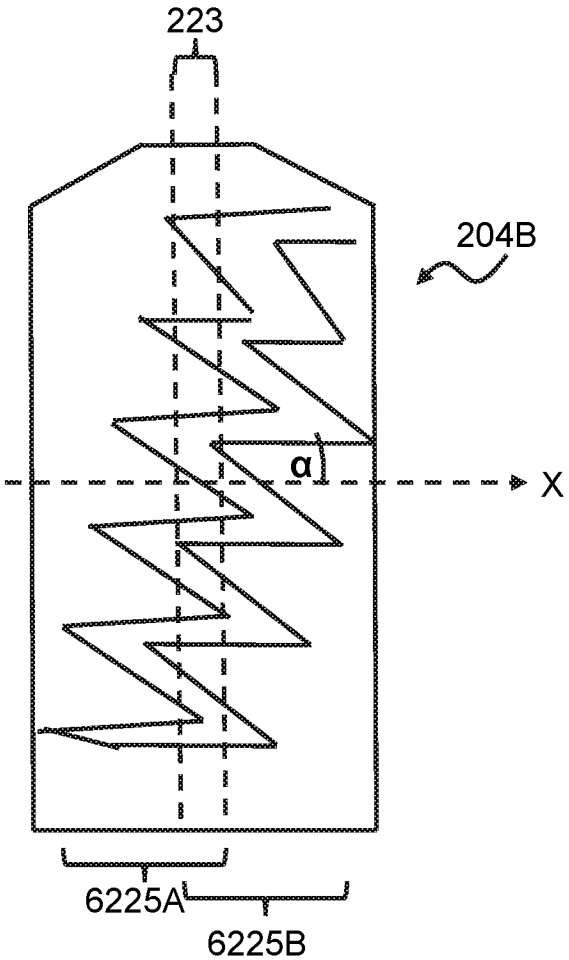
FIG. 12H

DEVICE, SYSTEM AND METHOD FOR STORING ITEMS

CROSS-REFERENCE TO RELATED APPLICATIONS

This application claims priority from U.S. Provisional Patent Application No. 62/247,404 filed on Oct. 28, 2015, titled "DEVICE, SYSTEM AND METHOD FOR STORING ITEMS" and which is expressly incorporated herein by reference in its entirety.

TECHNICAL FIELD

Embodiments described herein relate generally to devices, systems and methods for storing items.

BACKGROUND

Venue sites such as concerts halls, conference and exhibition centers hosting events are frequented by large numbers of people. Visitors of an event taking place indoors usually prefer to have personal items such as jackets, coats and/or other pieces of outer clothing be stored in cloakrooms accommodated on the venue site. However, items stored in such cloakrooms or wardrobes are prone to loss, theft or damage, even if stored under supervision by dedicated operating personnel.

OVERVIEW

Aspects of disclosed embodiments provide for securely storing personal items in a publicly accessible area.

Example 1 includes an item storage device for securely storing items comprising: a receptacle defining a storage area for receiving an item to be stored; a fastener for opening and closing the receptacle and which operably cooperates with a lock mechanism for selectively securing the fastener in a closed position and for unsecuring the fastener for allowing the fastener to be set from the closed into an open position; and an alarm system which is operably coupled with the receptacle and armed when the fastener is secured, the armed alarm system providing an output responsive to detecting that the structural integrity of the receptacle is compromised.

Example 2 includes the subject matter of example 1 and optionally, wherein the alarm system comprises at least one conductive pathway running along and/or within the body of the receptacle.

Example 3 includes the subject matter of example 2 and, optionally, wherein a plurality of conductive pathways form a mesh-like pattern matching the geometric structure of the receptacle's body.

Example 4 includes the subject matter of any of examples 1 to 3 and, optionally, wherein the fastener is a zipper mechanism comprising two rows of teeth that are interlockingly engageable with each other.

Example 5 includes the subject matter of example 4 and, optionally, wherein portions of the at least one conductive pathway extend below the rows of teeth.

Example 6 includes the subject matter of examples 4 or 5 and, optionally, wherein the at least one conductive pathway is electrically insulated from the teeth.

Example 7 includes the subject matter of any of example 1 to 6 and, optionally, wherein the storage device comprising a storage device hanging hardware for slidably coupling the storage device to a carrier bar, e.g., for allowing the sliding of the storage device in Z-direction.

Example 8 includes the subject matter of any of examples 1 to 7, wherein the receptacle comprises form-shaping elements.

Example 9 includes a storage system for securely storing a plurality of item storage devices, comprising at least one frame structure, wherein the at least one frame structure comprises a plurality of item hanging hardware mechanisms for receiving items for storage, and a plurality of item storage devices comprising receptacles that are non-removably coupled to the frame structure and fasteners for opening and closing the respective receptacles, wherein each one of the fasteners operably cooperates with a lock mechanism of the storage system for selectively securing the fastener in a closed position and for unsecuring the fastener for allowing the fastener to be set from the closed into an open position; and an alarm system that is operably coupled with the plurality of receptacles, wherein the alarm system is selectively armed or unarmed for a corresponding item storage device when the fastener associated with corresponding item storage device is secured or unsecured, respectively; and wherein the alarm system, when armed, provides an output responsive to detecting that the structural integrity of the receptacle is compromised.

Example 10 includes the subject matter of example 9 and, optionally, wherein the item hanging hardware mechanisms are reversibly extendable out of the receptacles.

Example 11 includes the subject matter of examples 9 or 10, and wherein the storage system optionally comprises a plurality of frame bodies that are modularly connectable.

Example 12 includes the subject matter of any of examples 9 to 11 and, optionally, wherein the lock mechanism comprises an identification mechanism selected from a group comprising mechanical key-based identification; electronic key-based identification; passcode-based identification; biometric-based identification; and any combination of the aforesaid.

Example 13 includes the subject matter of any of examples 9 to 12 and, optionally, wherein user identification information can be provided onsite to the lock mechanism of the storage system and/or remotely via a mobile computerized end-user device that is associated with a user of the storage system.

Example 14 includes the subject matter of any of examples 9 to 13 and, optionally, wherein the receptacles comprise form-shaping elements.

Example 15 includes the subject matter of any of examples 9 to 14 and, optionally, wherein the lock mechanism comprises: a retention element; and a safety mechanism that prevents the activation of the alarm system, unless the fastener (e.g., a zipper mechanism) for closing the receptacle is properly closed.

Example 16 includes a method for securely storing an item, comprising: causing electric current to flow in conductive pathways embedded in a receptacle enclosing a storage area; monitoring a parameter relating to the electric current flowing in the conductive pathways; and providing, in response to a detected change in the monitored parameter, an output which is indicative of an attempt of gaining unauthorized access to the storage area.

Example 17 includes a transitory and/or non-transitory computer readable storage medium storing a set of instructions that are executable by at least one processor of an alarm system of a storage system to cause the alarm system to perform the following steps: causing electric current to flow in conductive pathways embedded in a receptacle enclosing a storage area; monitoring a parameter relating to the electric current flowing in the conductive pathways; and providing, in response to a detected change in the monitored parameter, an output which is indicative of an attempt of gaining unauthorized access to the storage area.

Example 18 includes a method of manufacturing an item storage device according to any of examples 1 to 8, comprising: interposing electrically conductive trace between two electrically insulating sheets; applying a fastener device to the electrically insulating sheets; and coupling the insulating sheets to form a receptacle comprising a storage area for securely storing items therein.

Example 19 includes the use of an item storage device according to any of examples 1 to 8.

Example 20 includes the use of a storage system according to any of examples 9 to 14.

This overview is provided to introduce a selection of concepts in a simplified form that are further described below in the Description of the Figures and the Detailed Description. This summary is not intended to identify key features or essential features of the claimed subject matter, nor is it intended to be used to limit the scope of the claimed subject matter.

BRIEF DESCRIPTION OF THE FIGURES

The figures illustrate generally, by way of example, but not by way of limitation, various embodiments discussed in the present document.

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

The number of elements shown in the Figures should by no means be construed as limiting and is for illustrative purposes only.

Figure 1:
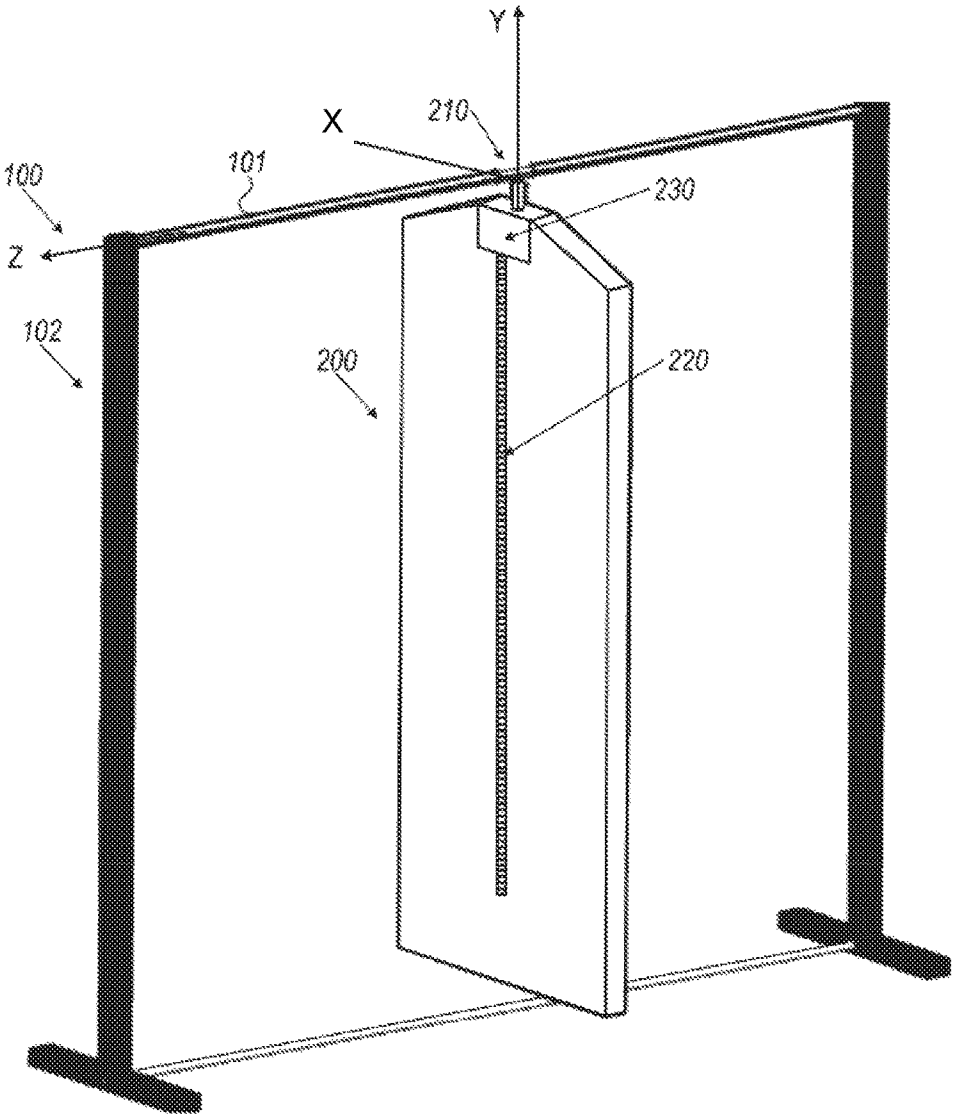
Figure 2B:
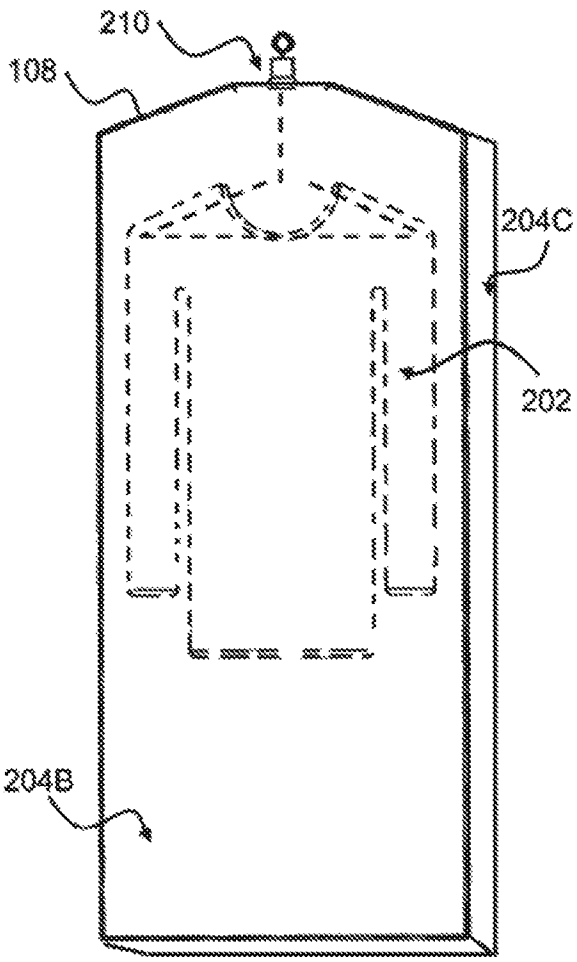
Figure 2A:
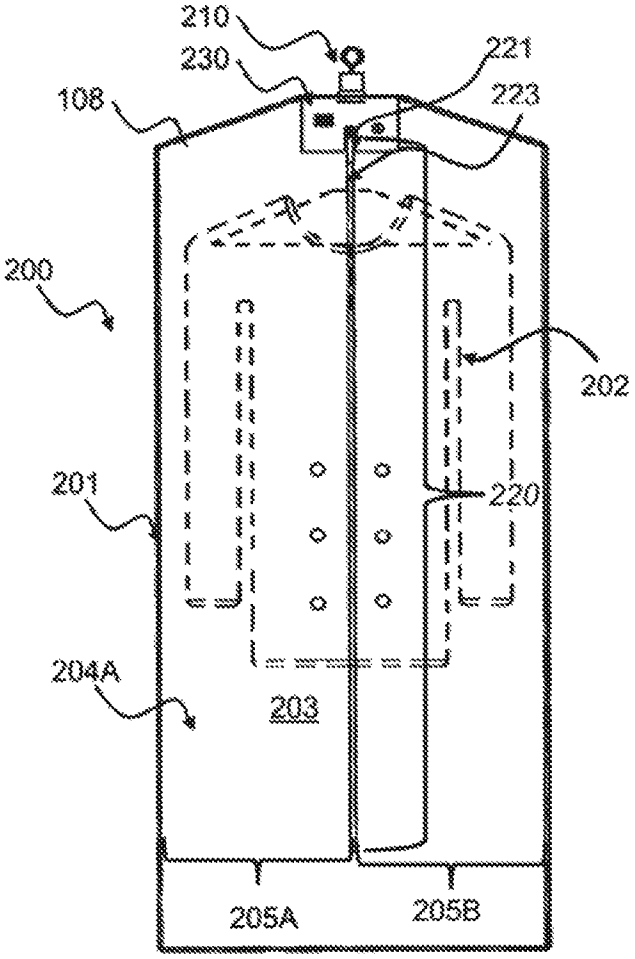
Figure 3A:
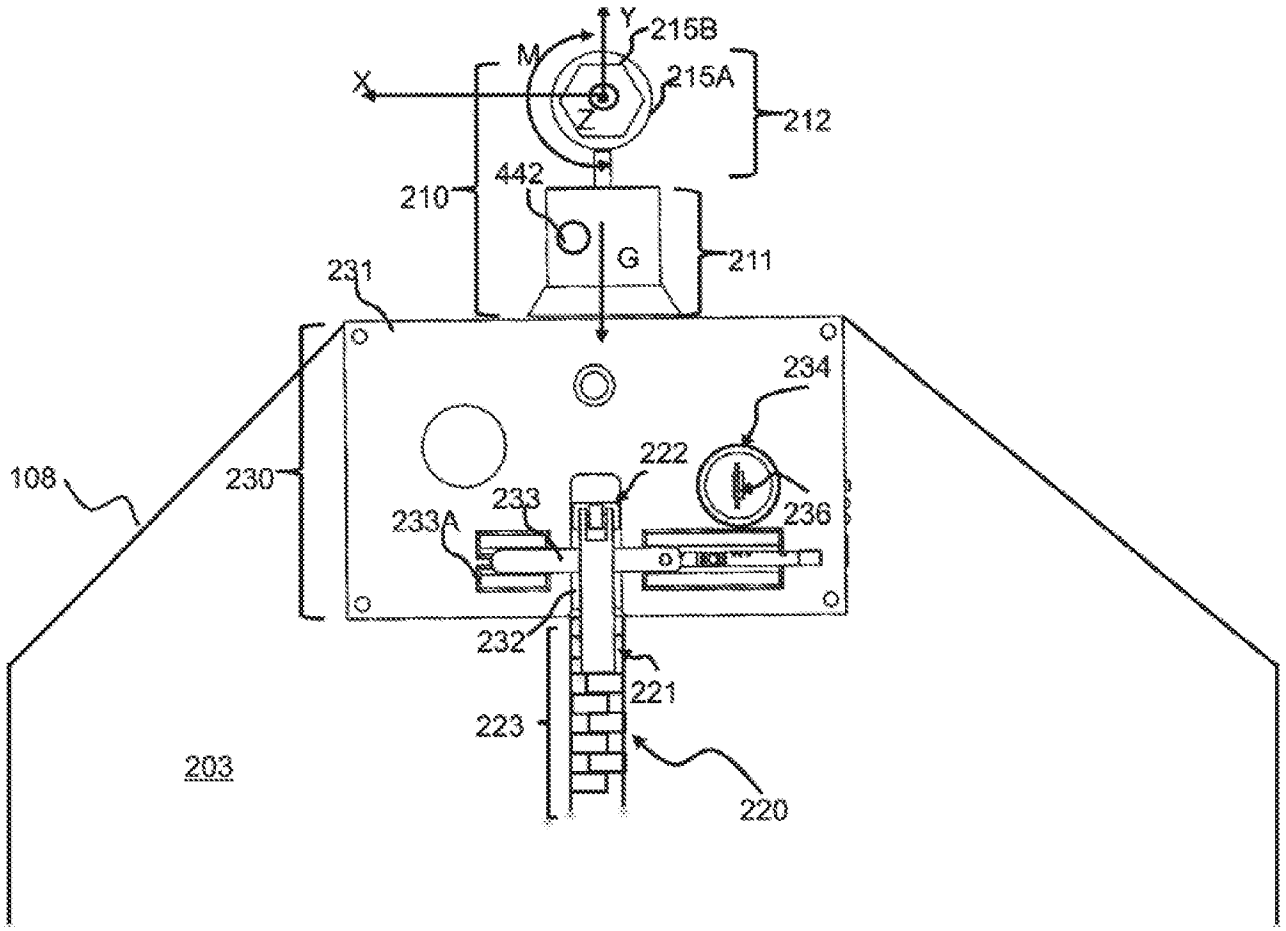
Figure 3B:
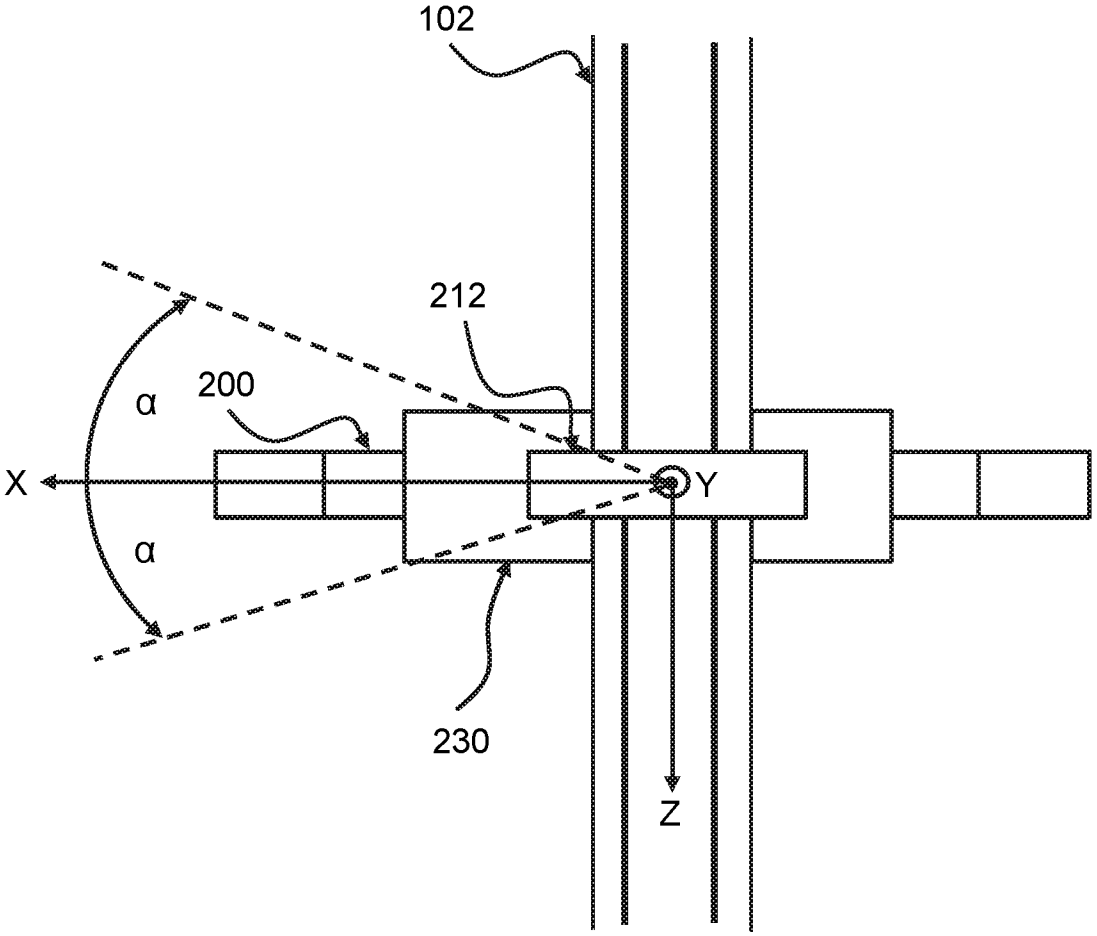
Figure 4:
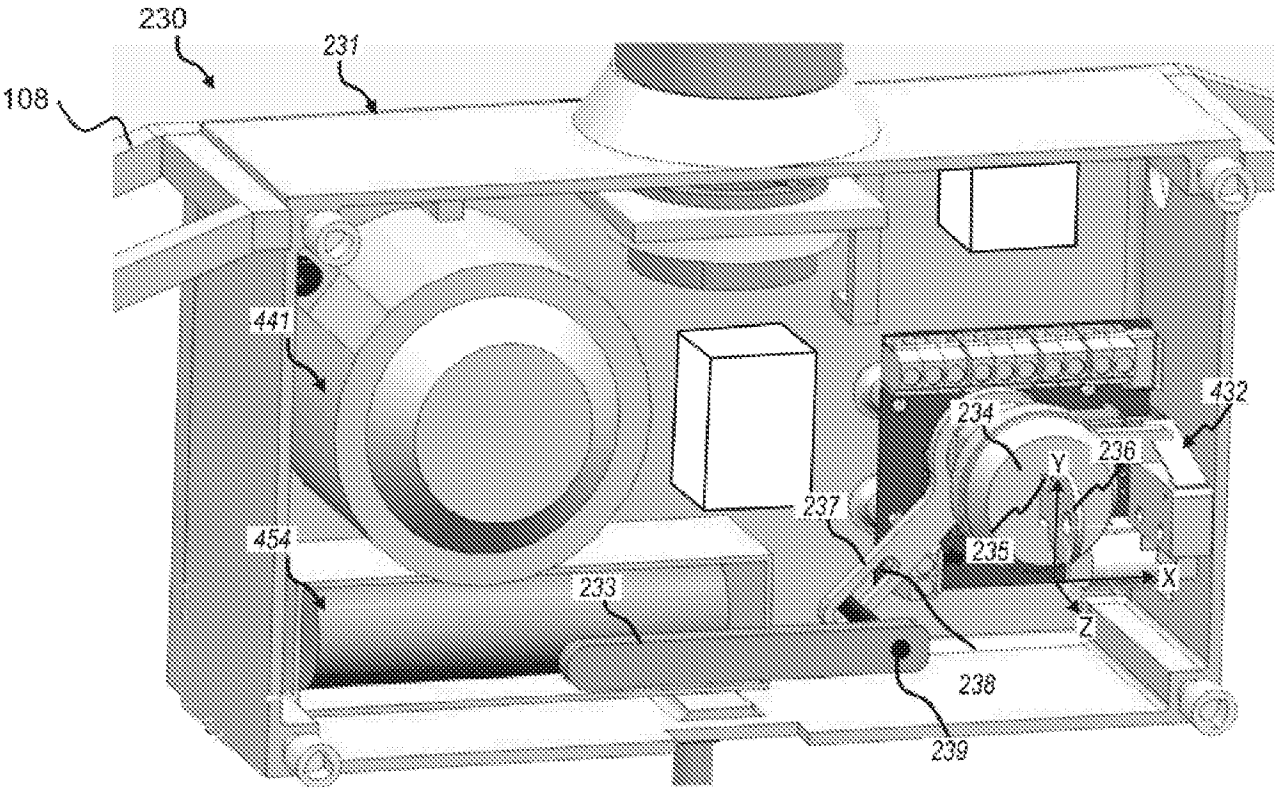
Figure 5:
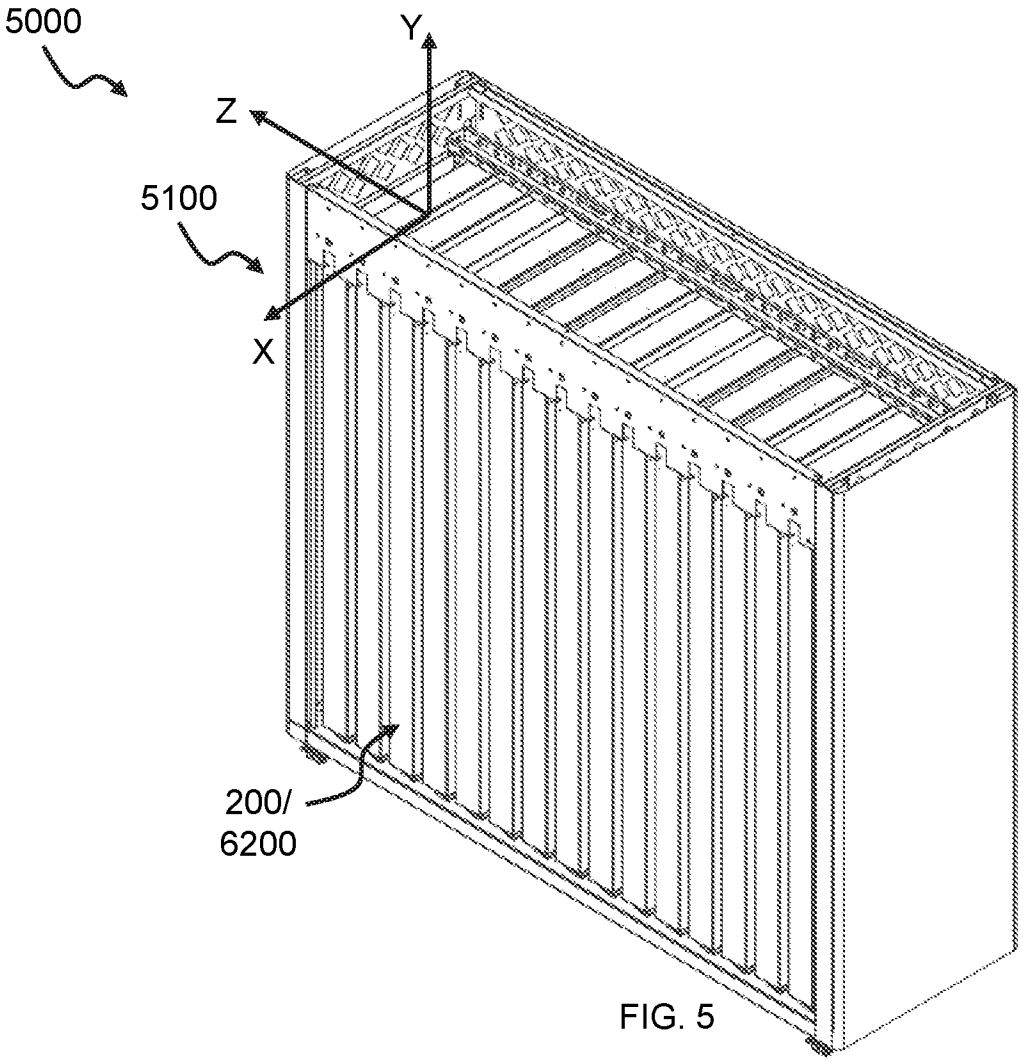
Figure 6B:
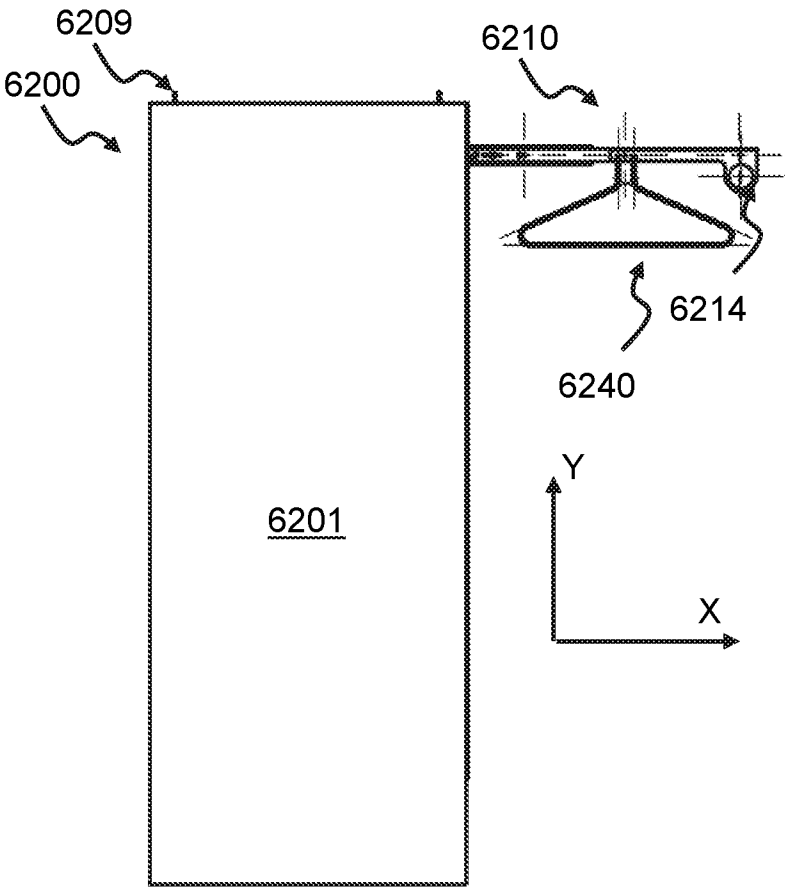
Figure 6A:
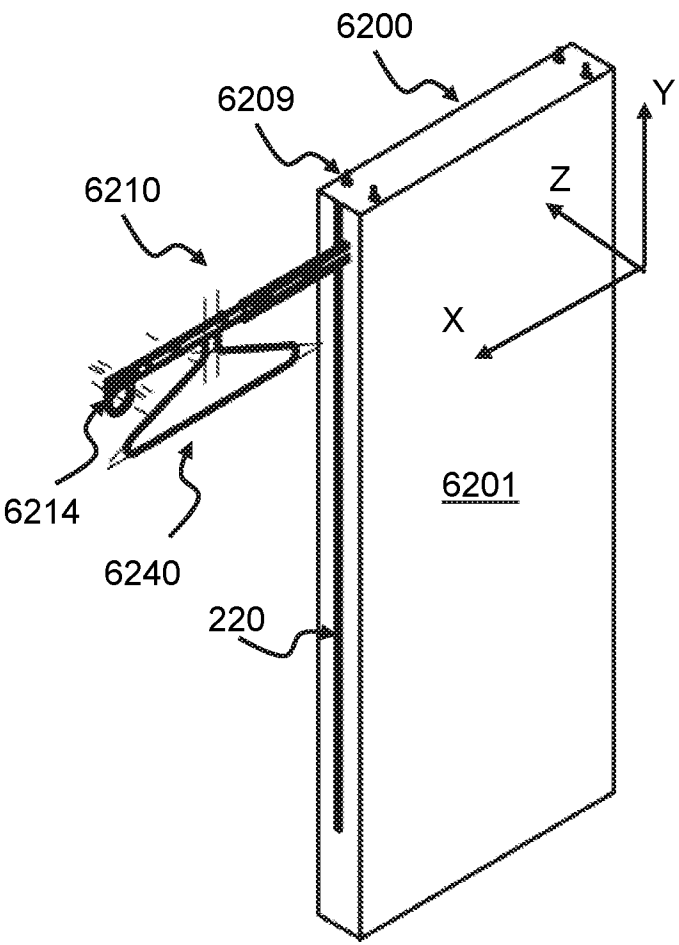
Figures 6C, 6D:
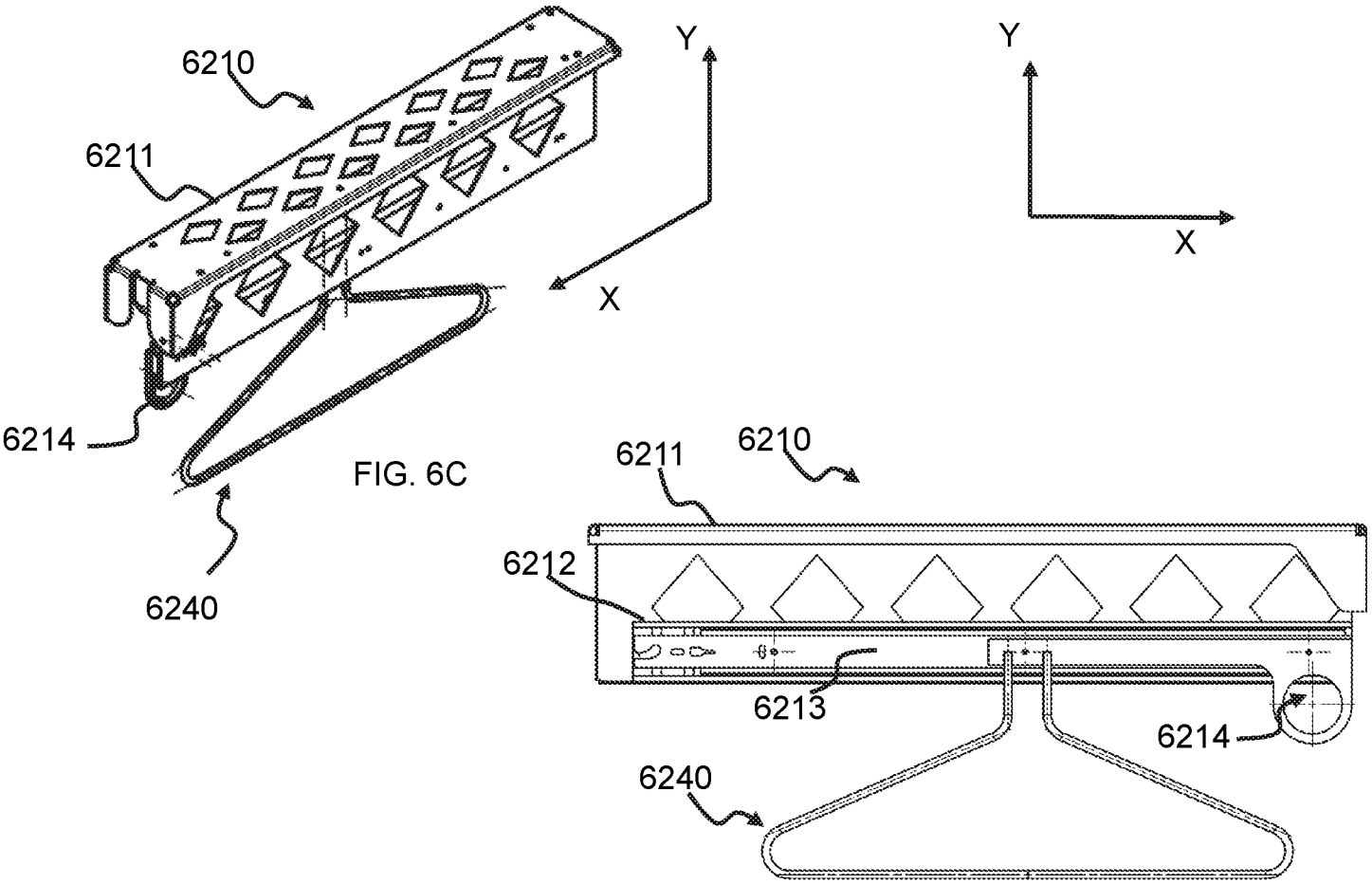
Figure 6E:
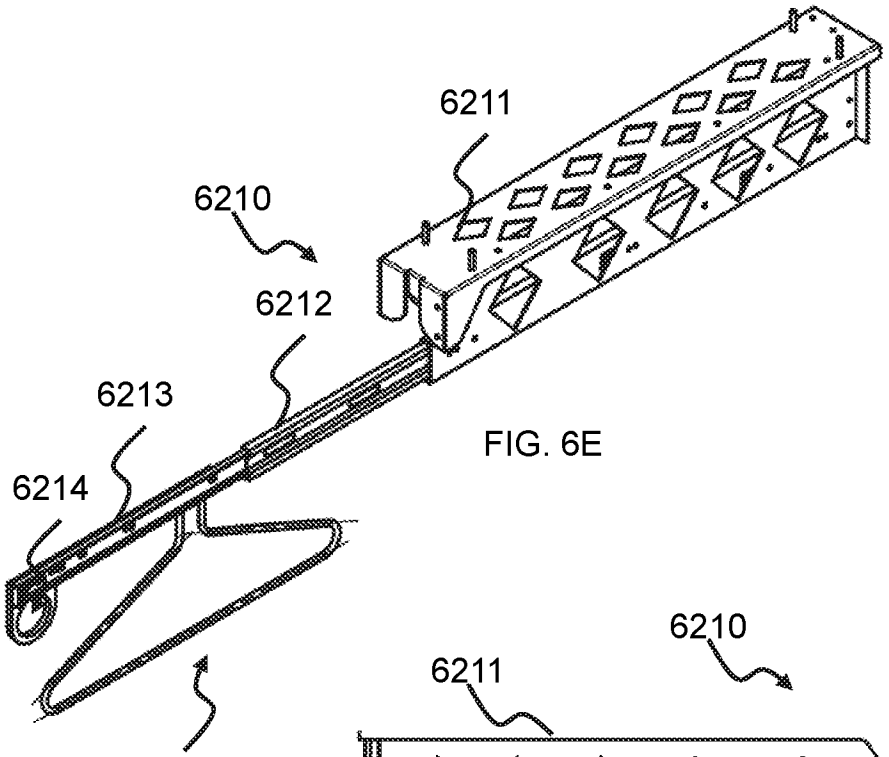
Figure 6F:
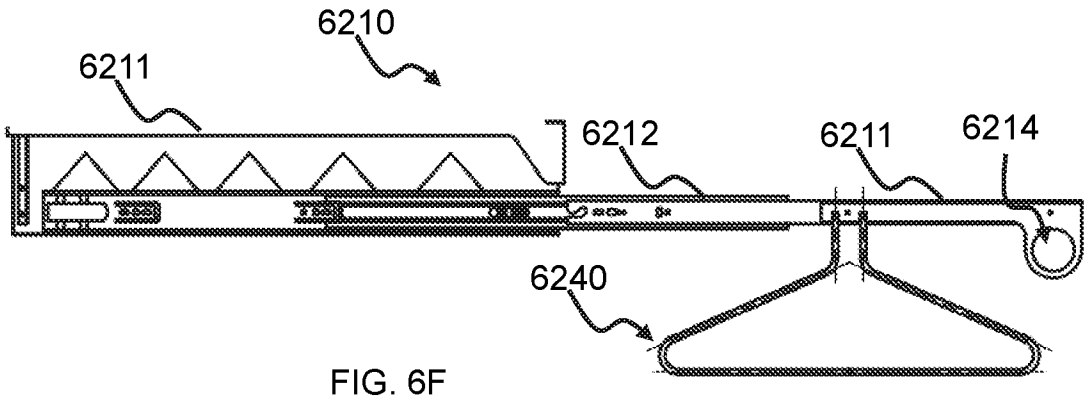
Figure 7B:
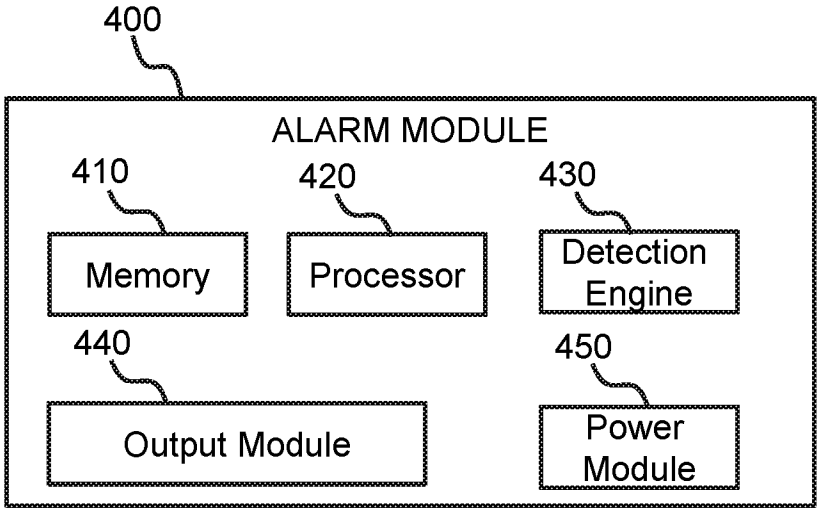
Figure 7C:
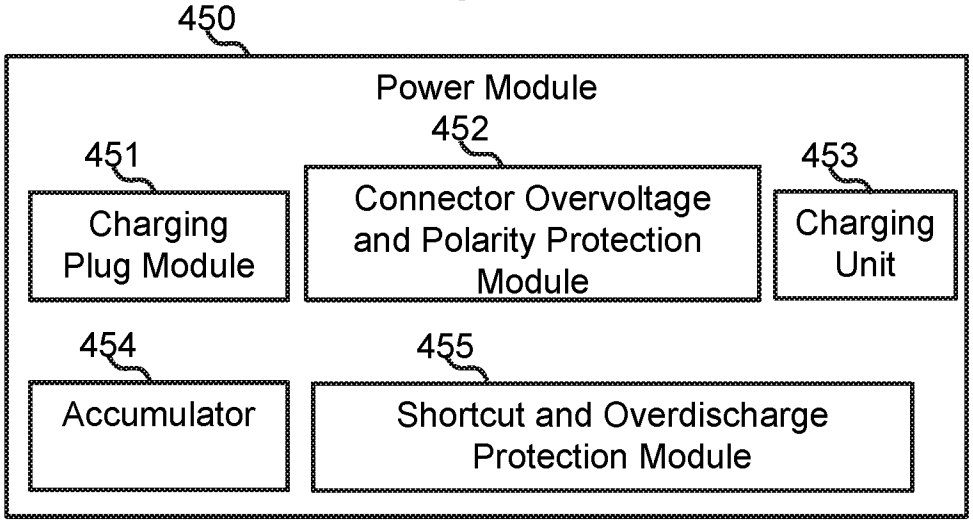
Figure 7A:
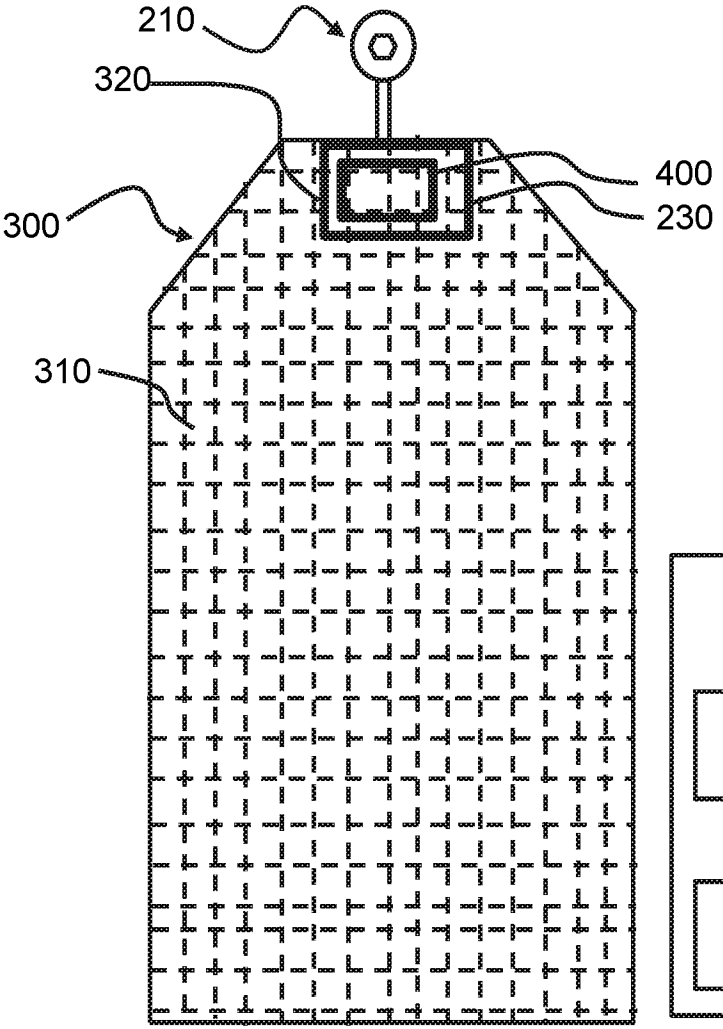
Figure 8:
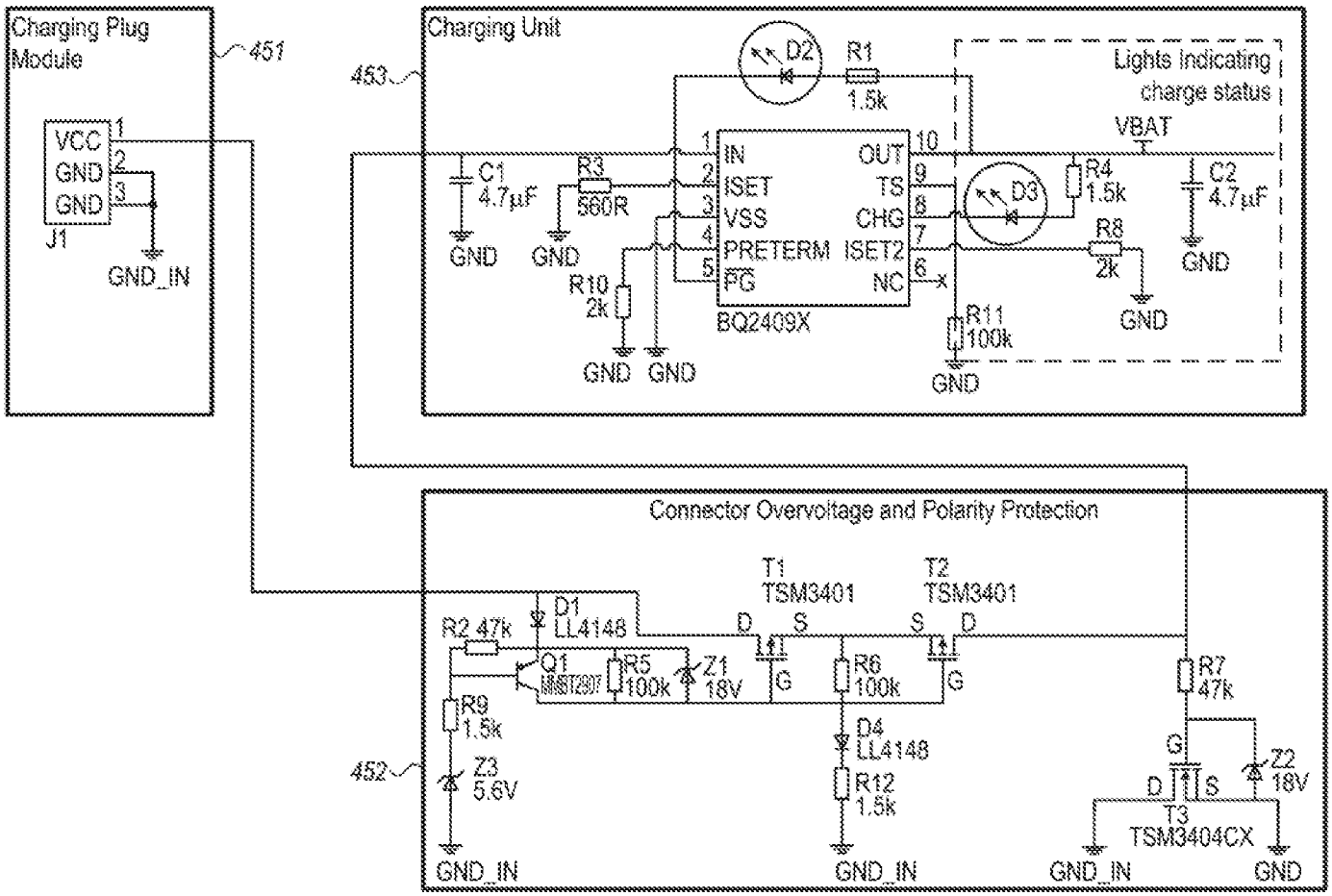
Figure 9:
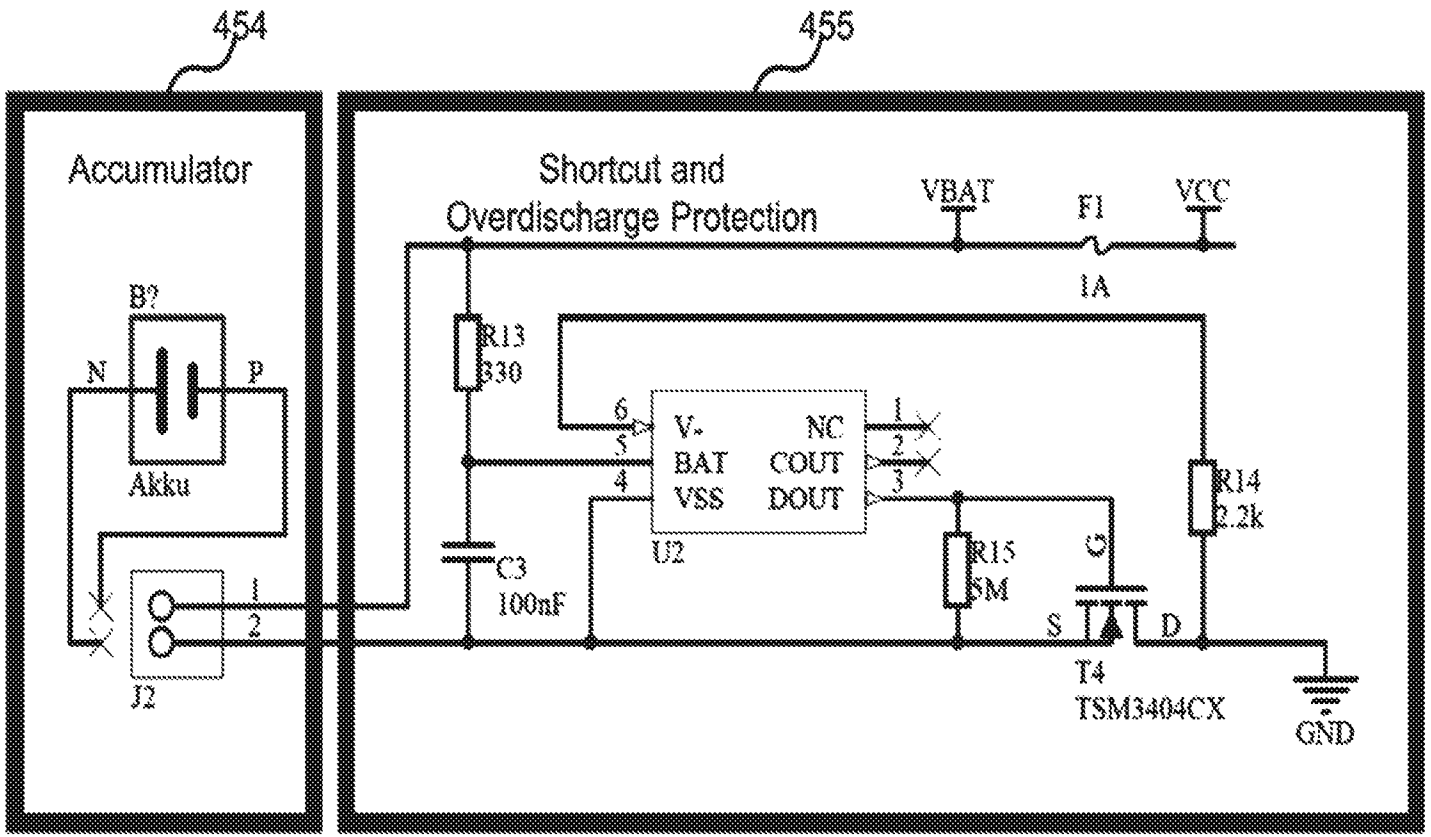
Figure 10B:
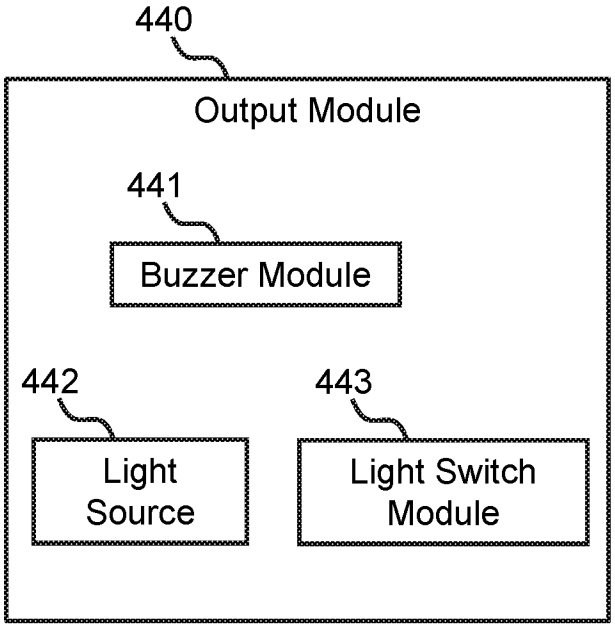
Figure 10A:
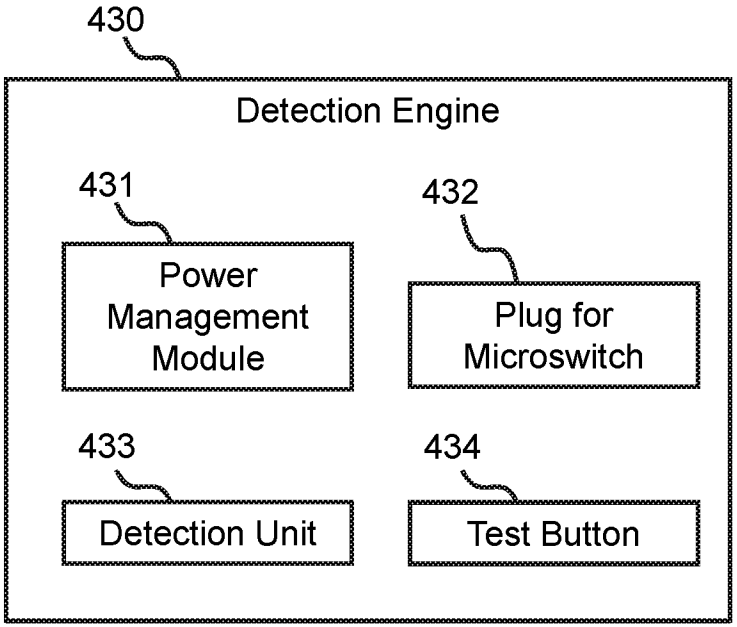
Figure 11A:
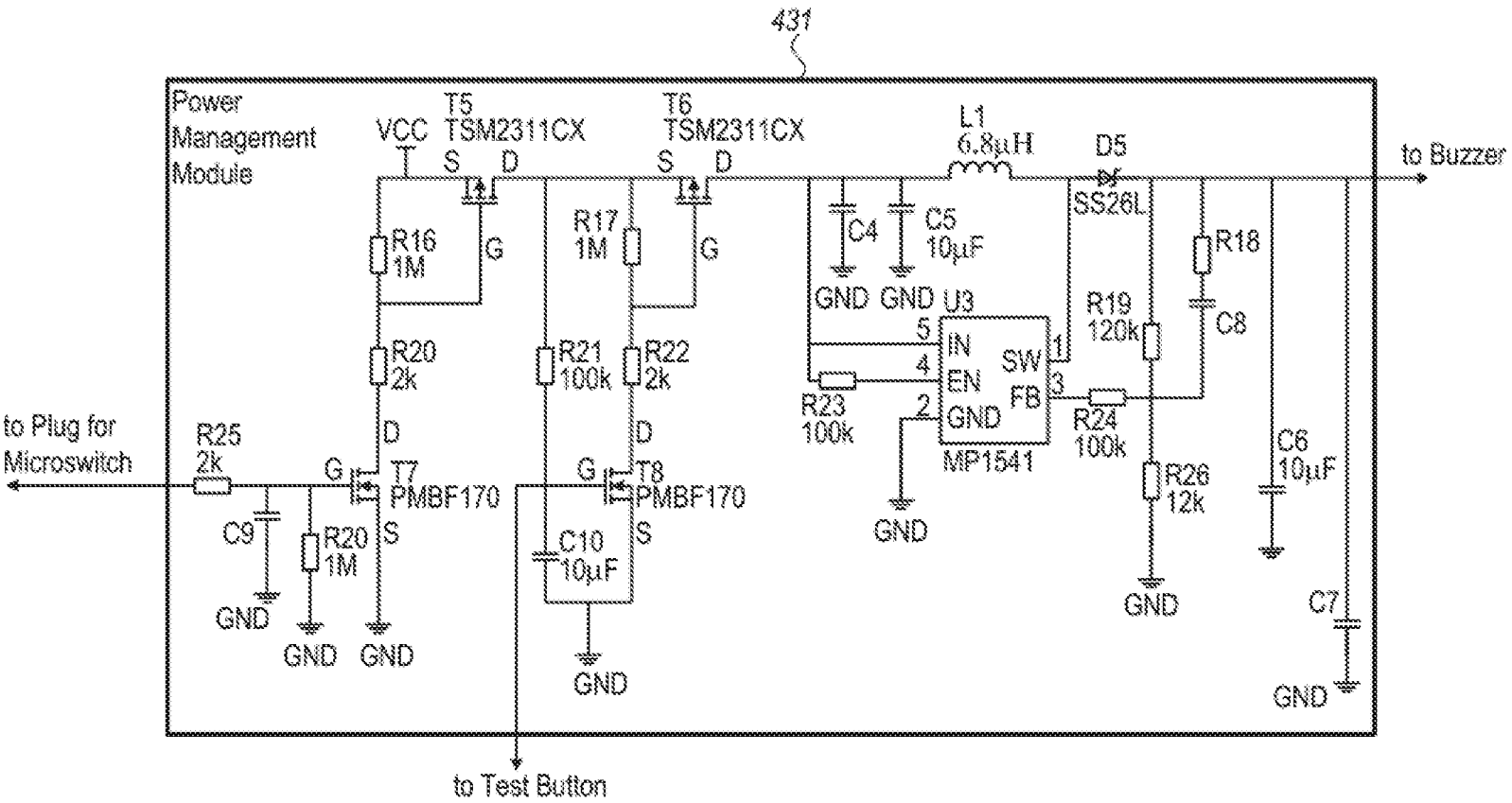
Figure 11C:
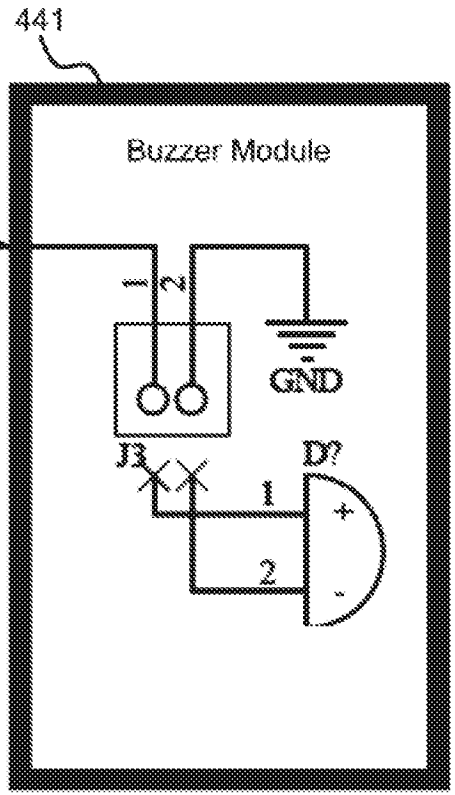
Figure 11B:
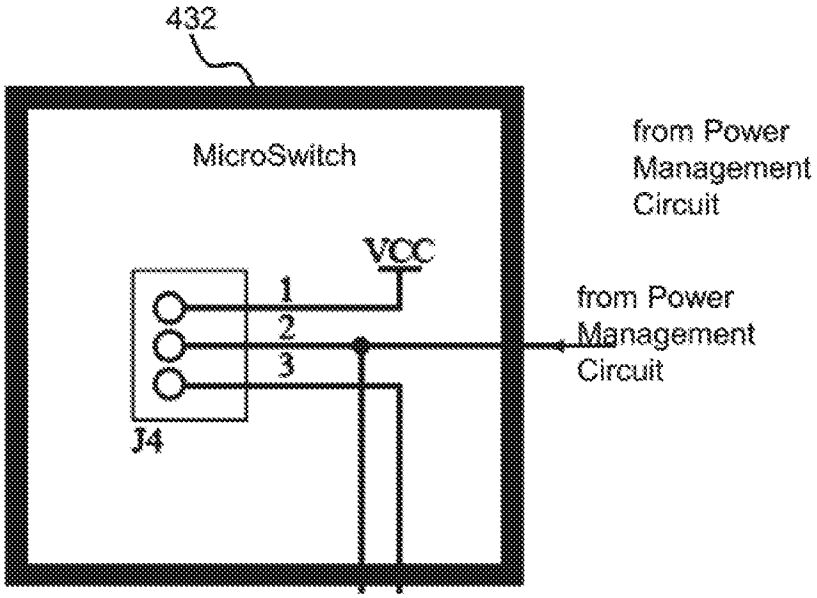
Figure 11D:
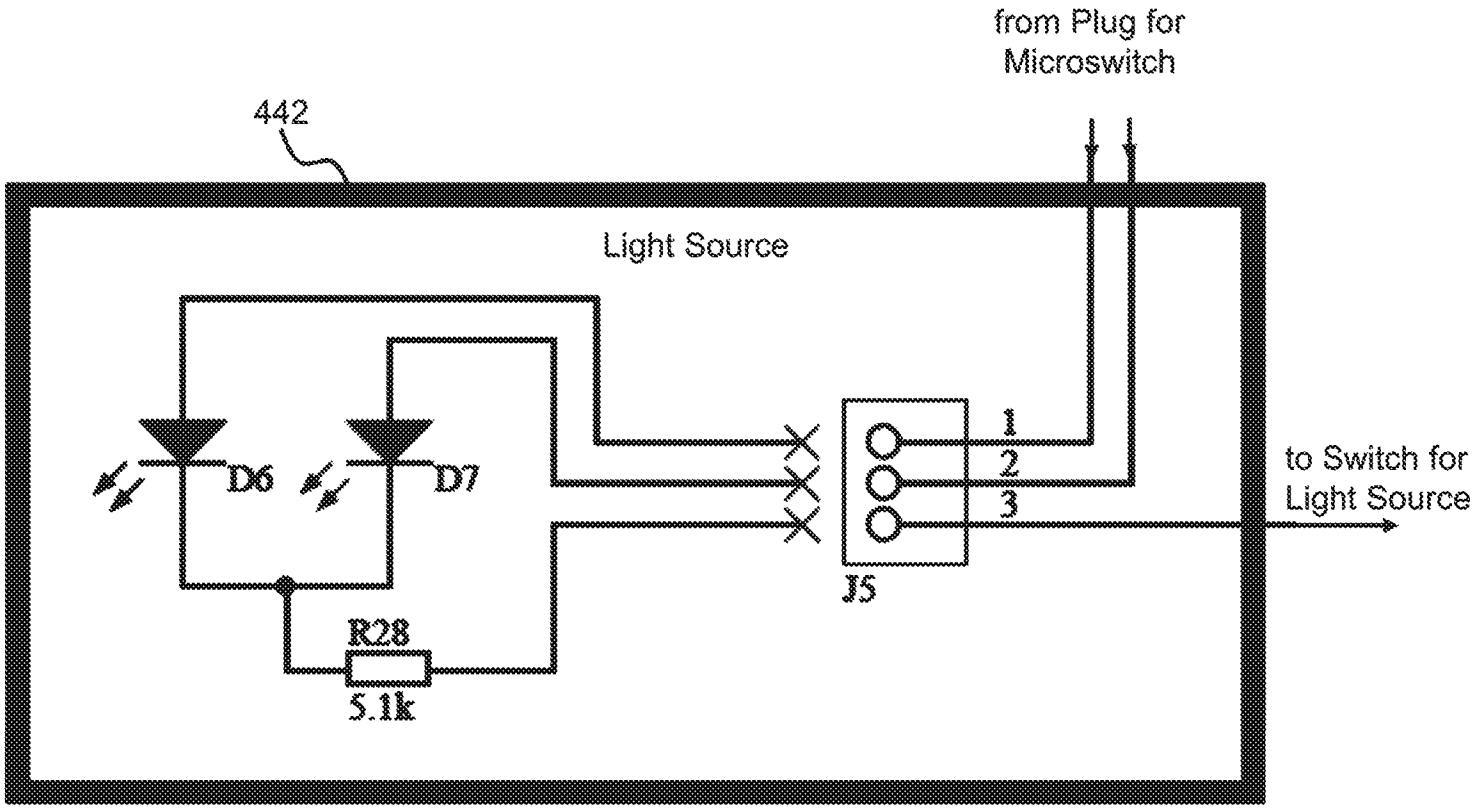
Figure 11E:
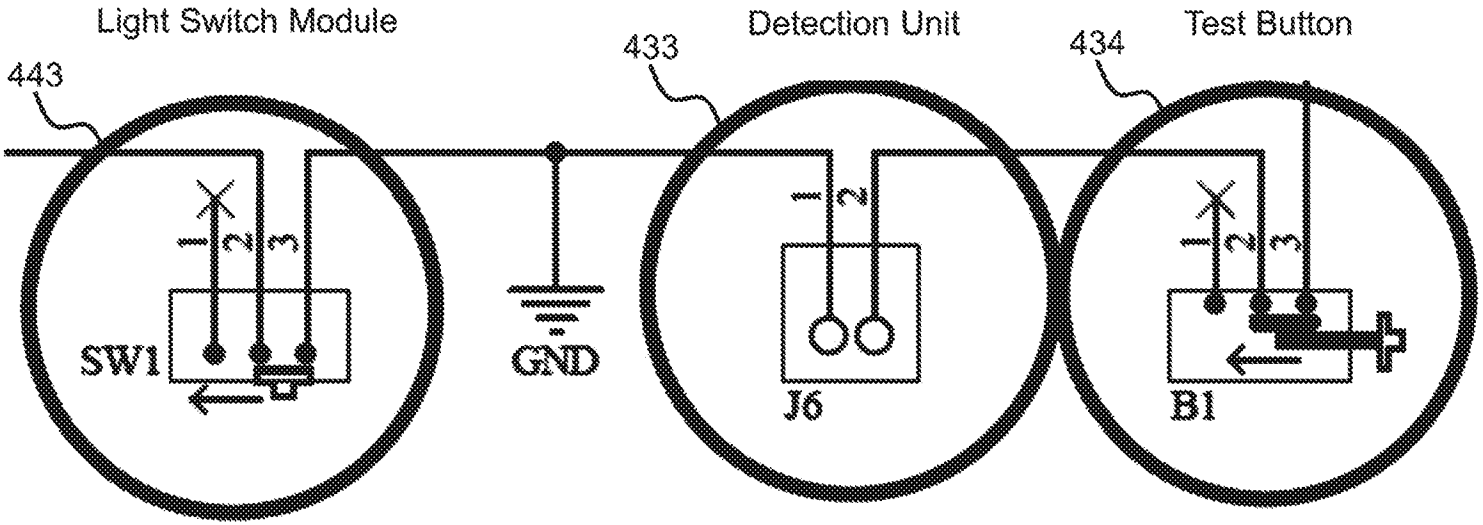
Figure 12C:
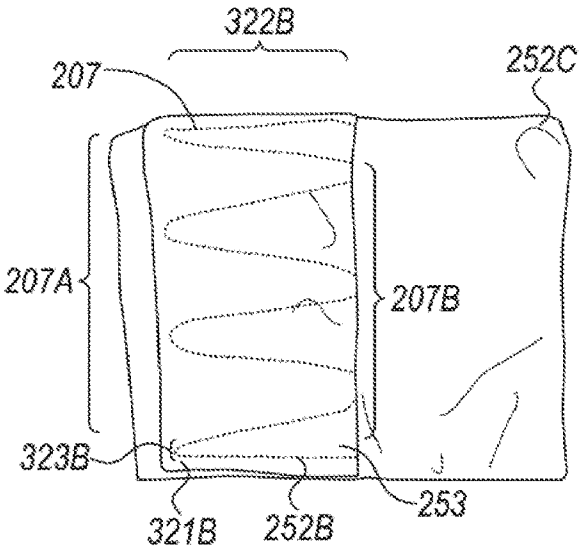
Figure 12D:
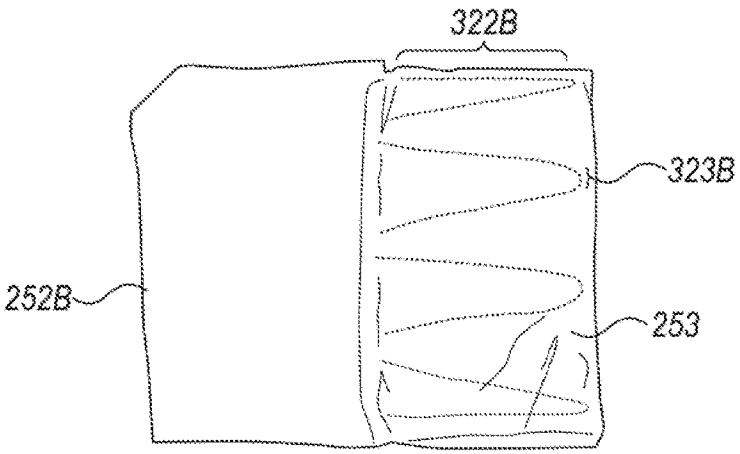
Figure 12A:
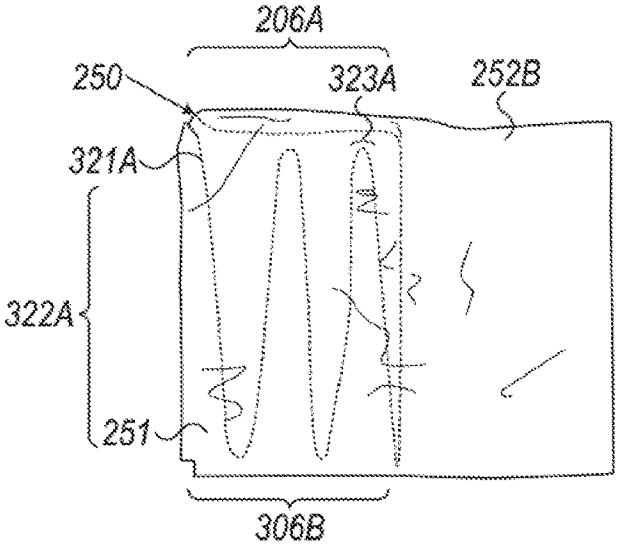
Figure 12B:
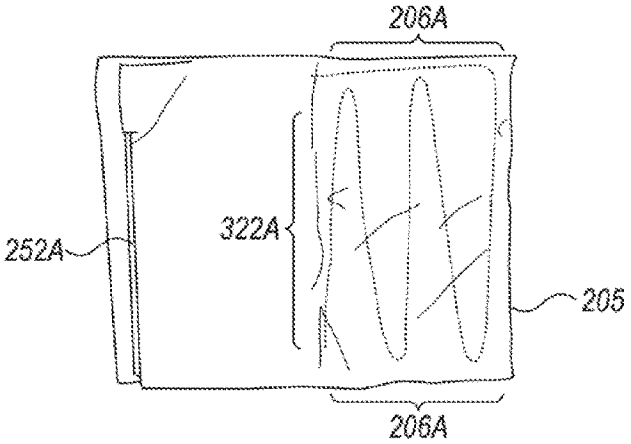
Figure 13:
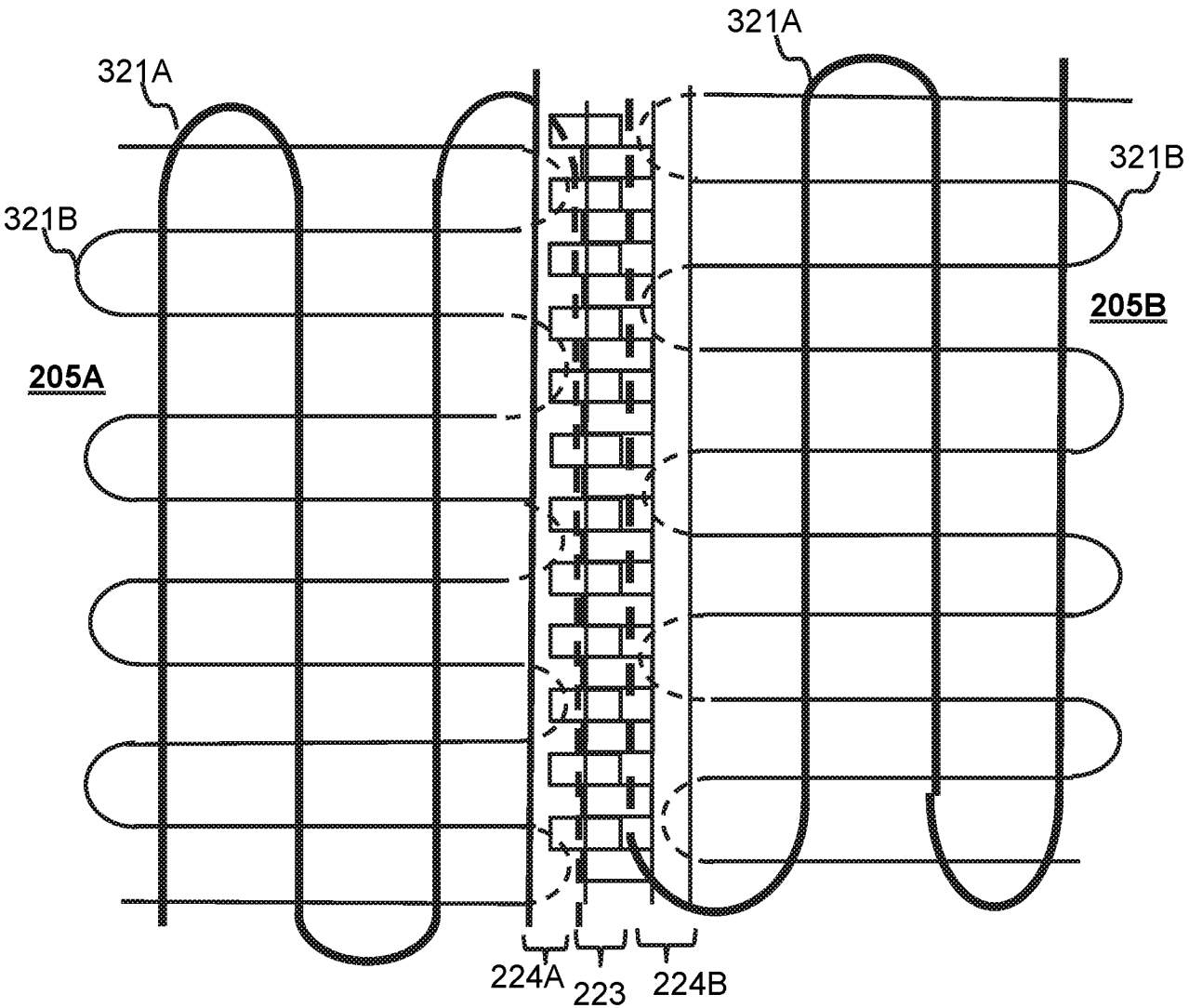
Figure 14A:
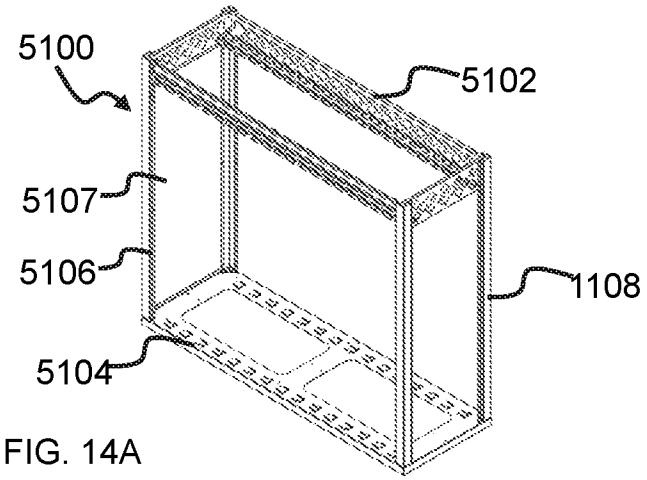
Figure 14B:
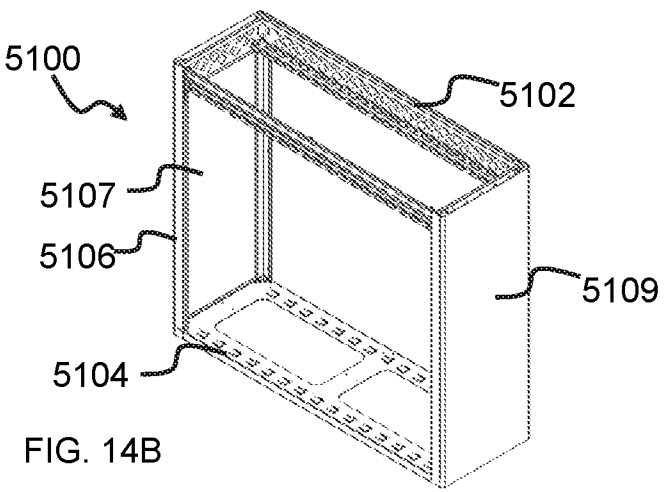
Figure 14C:
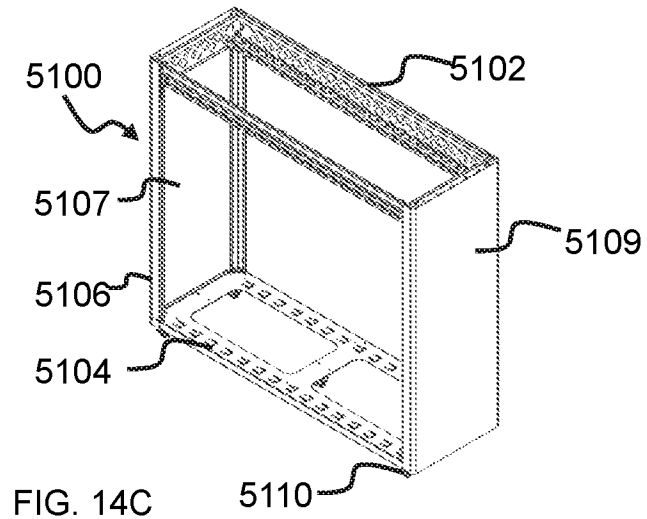
Figure 14D:
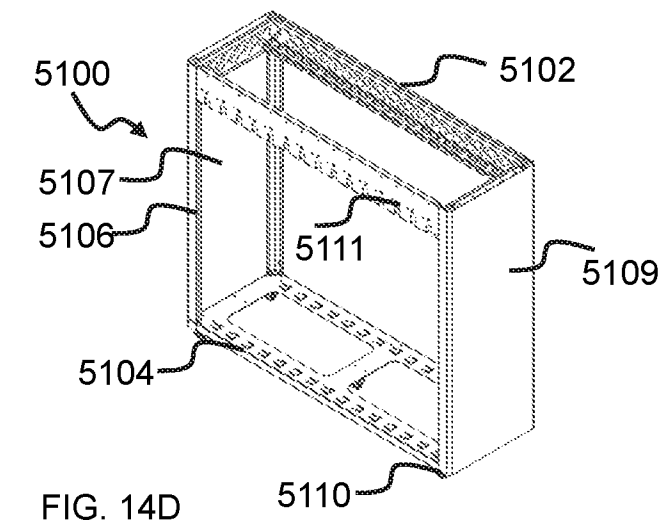
Figure 14F:
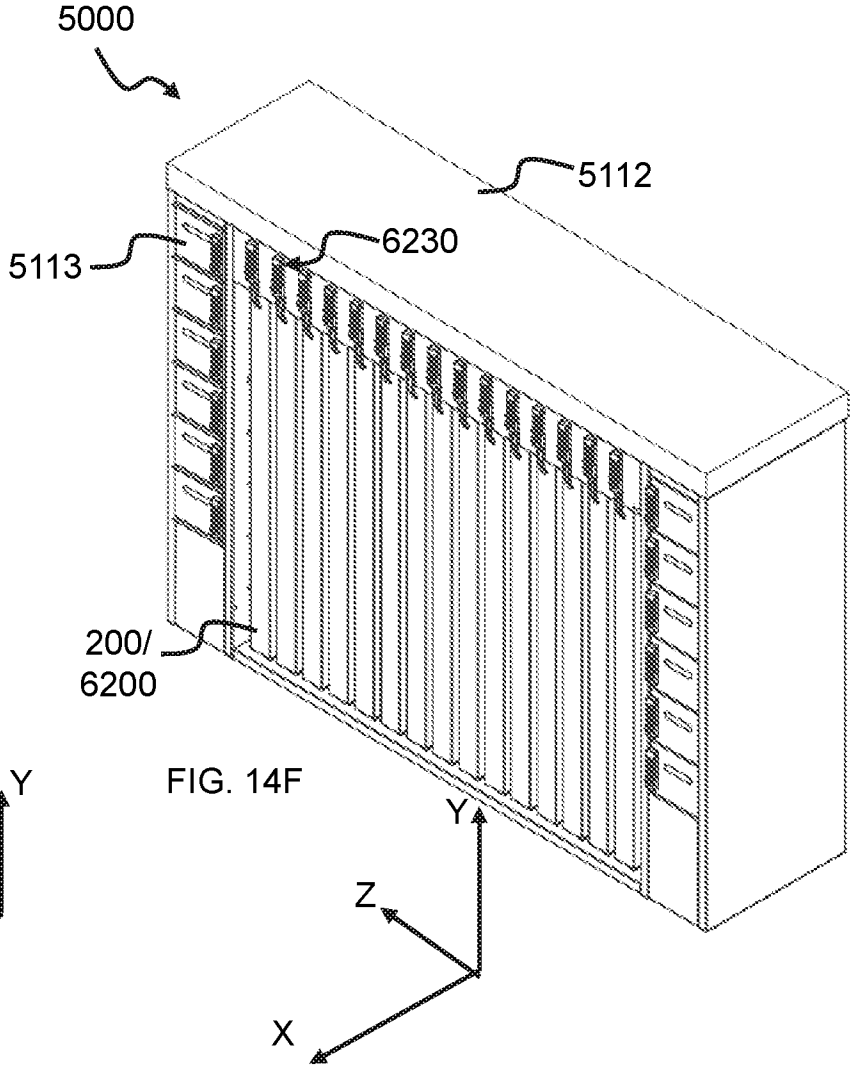
Figure 14E:
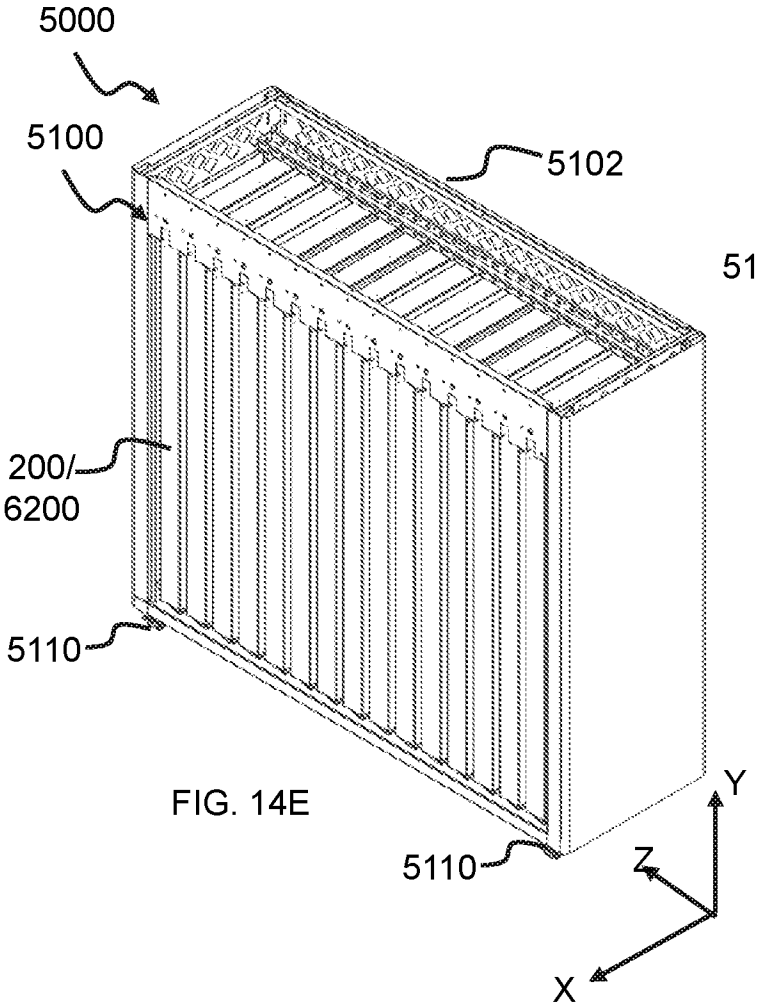
Figure 15B:
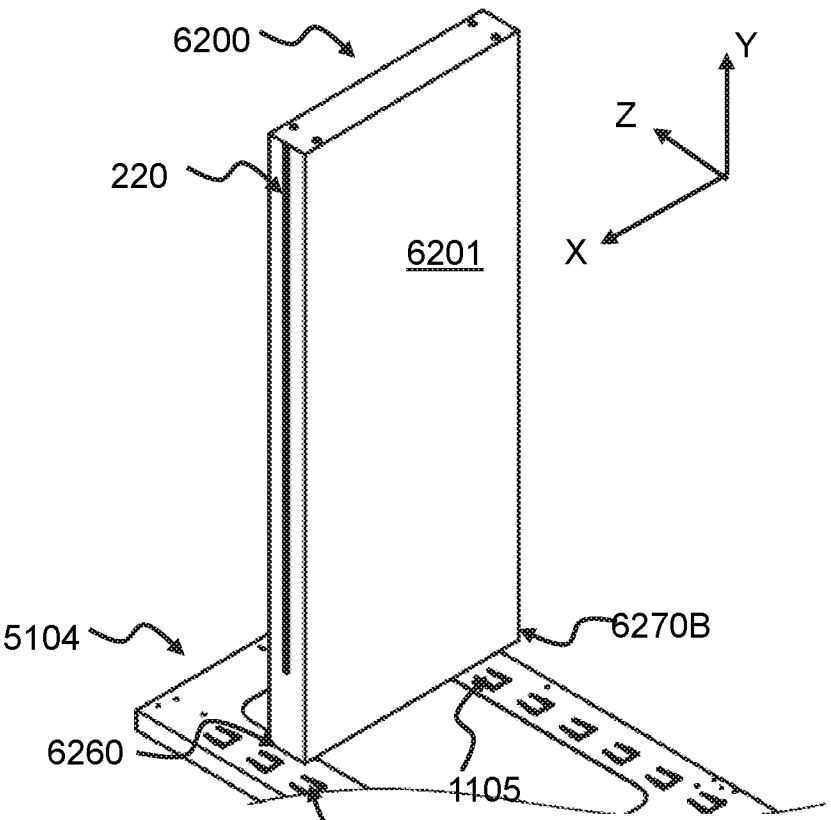
Figure 15A:
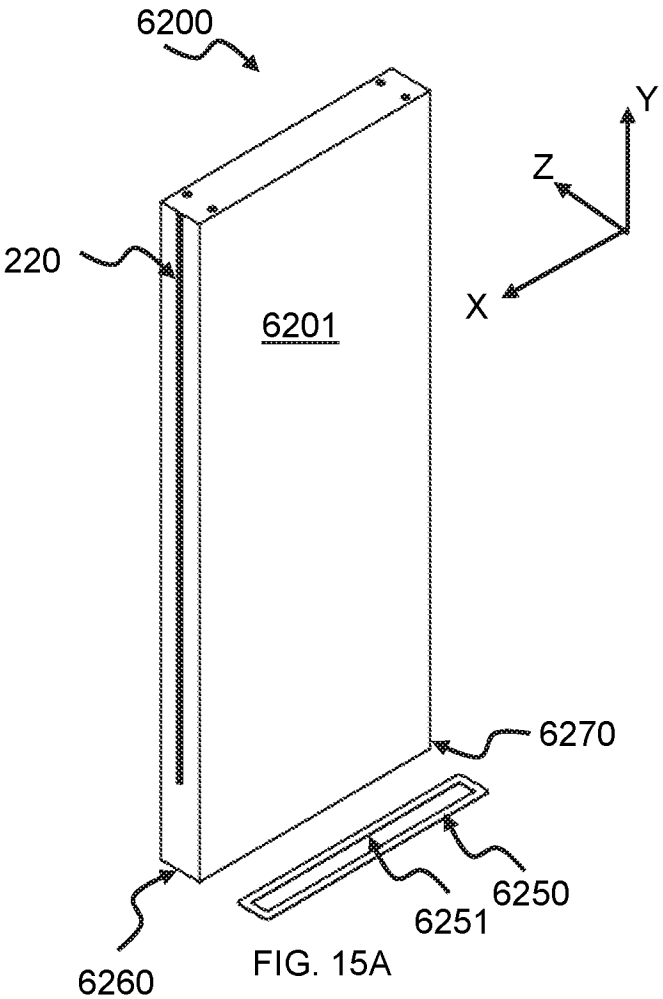
Figure 16B:
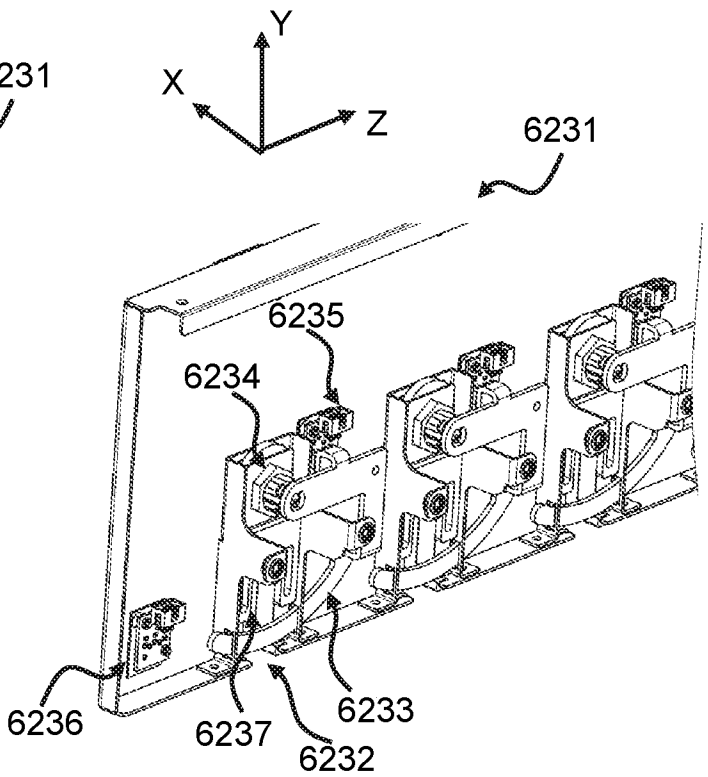
Figure 16A:
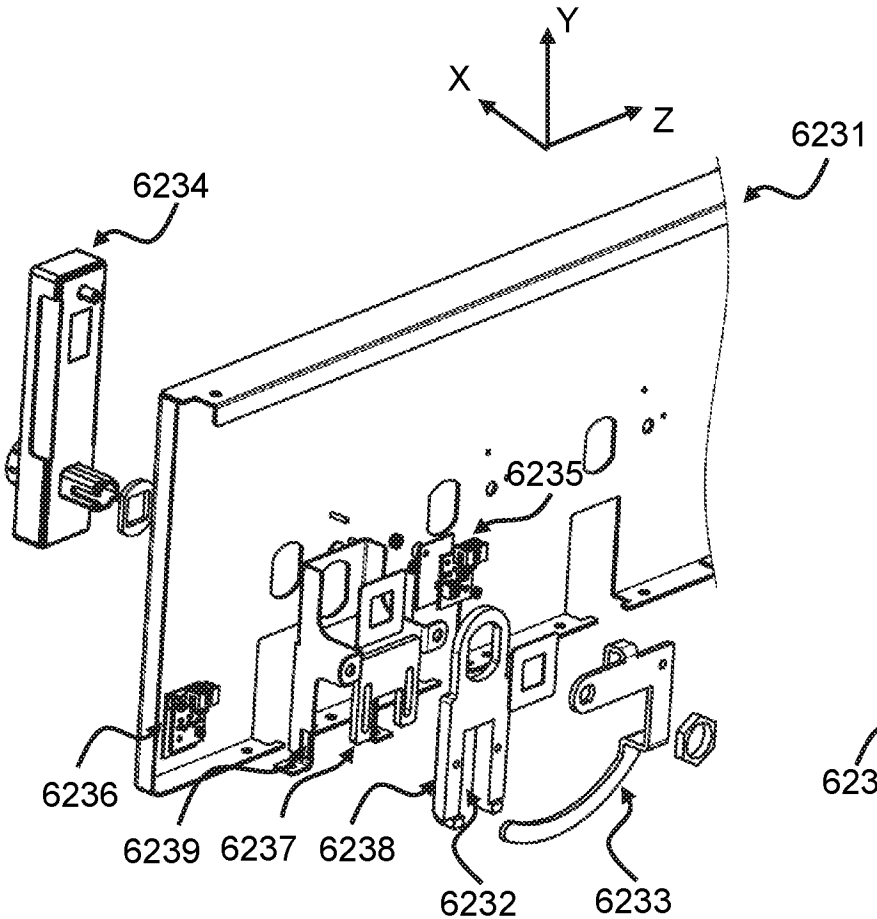
Figure 16D:
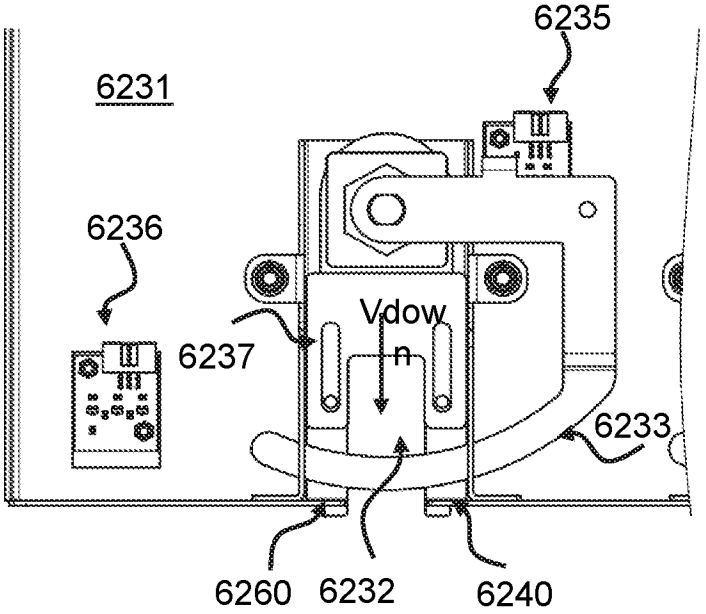
Figure 16C:
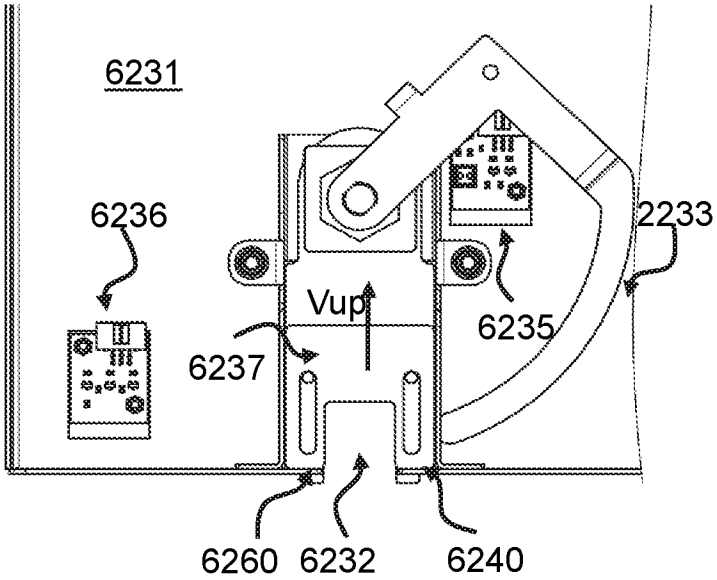
Figure 17B:
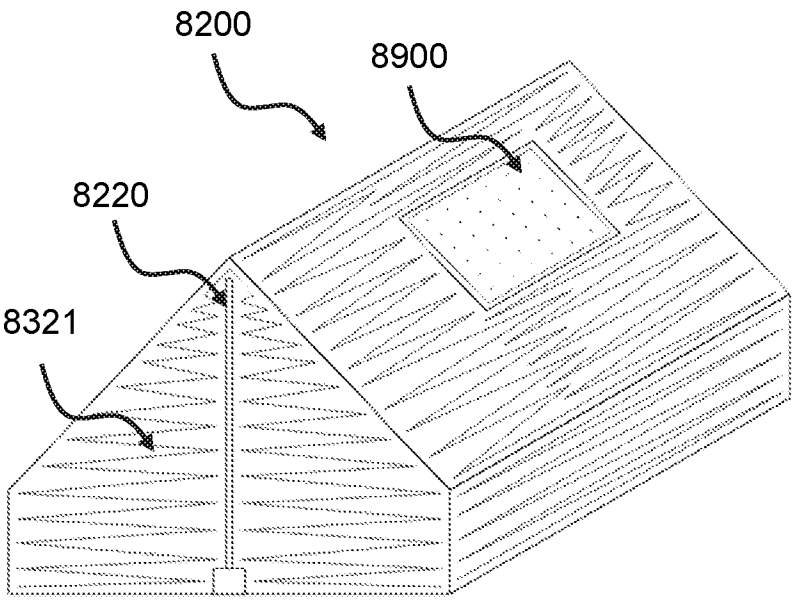
Figure 17A:
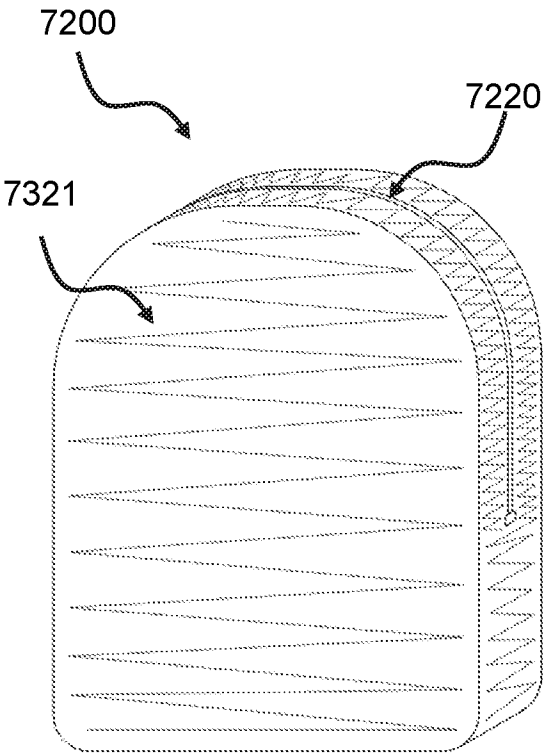
Figure 18:
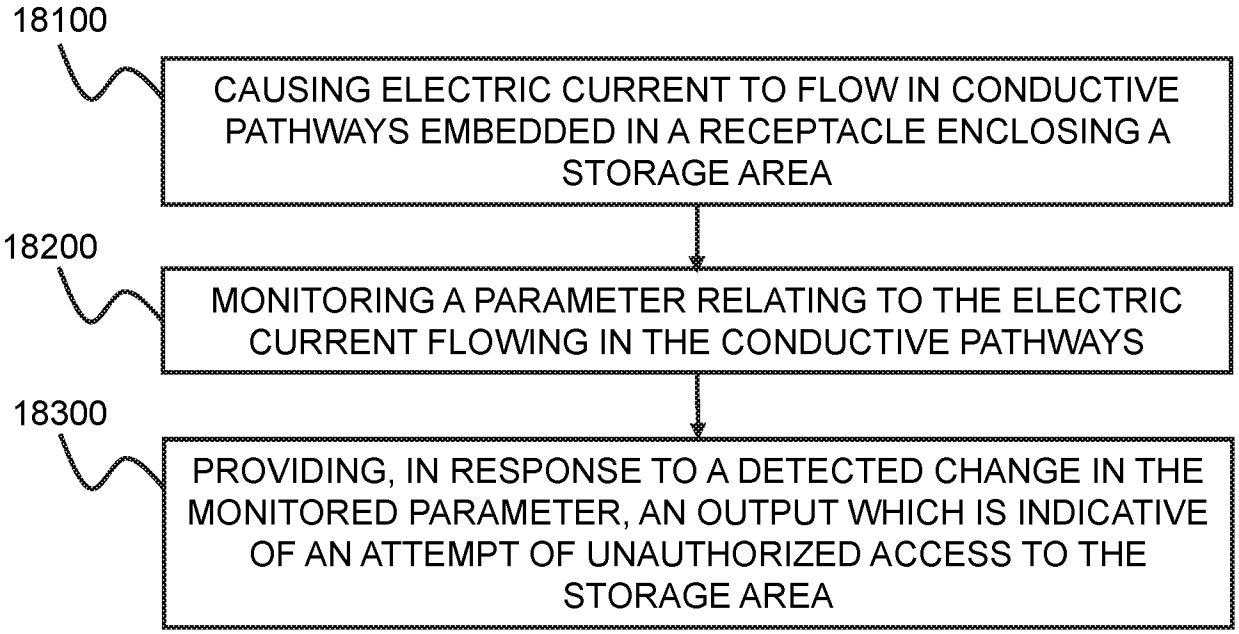
Figure 19:
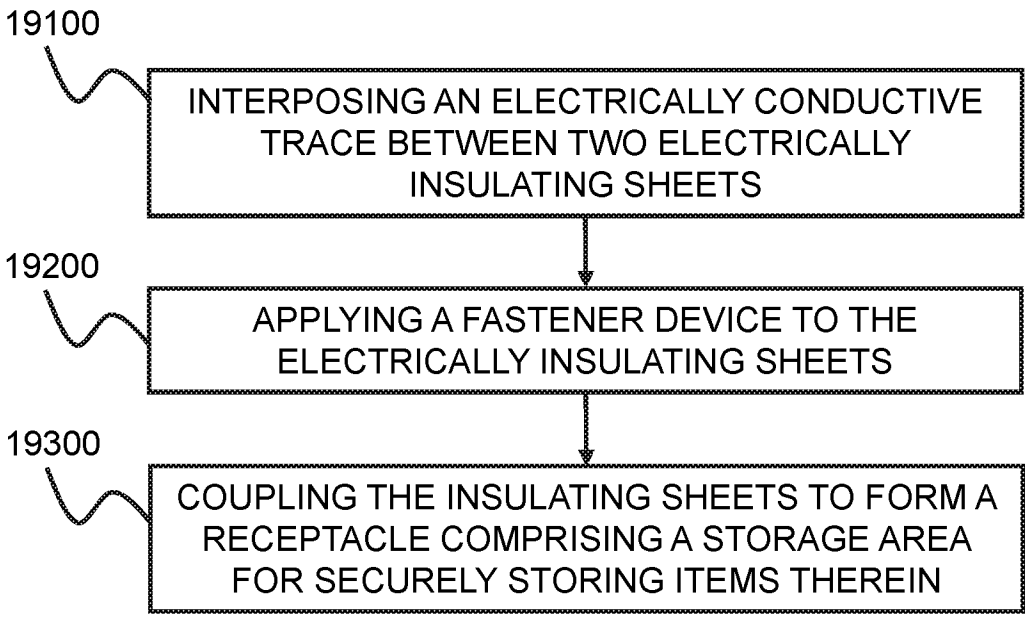
Figure 20:
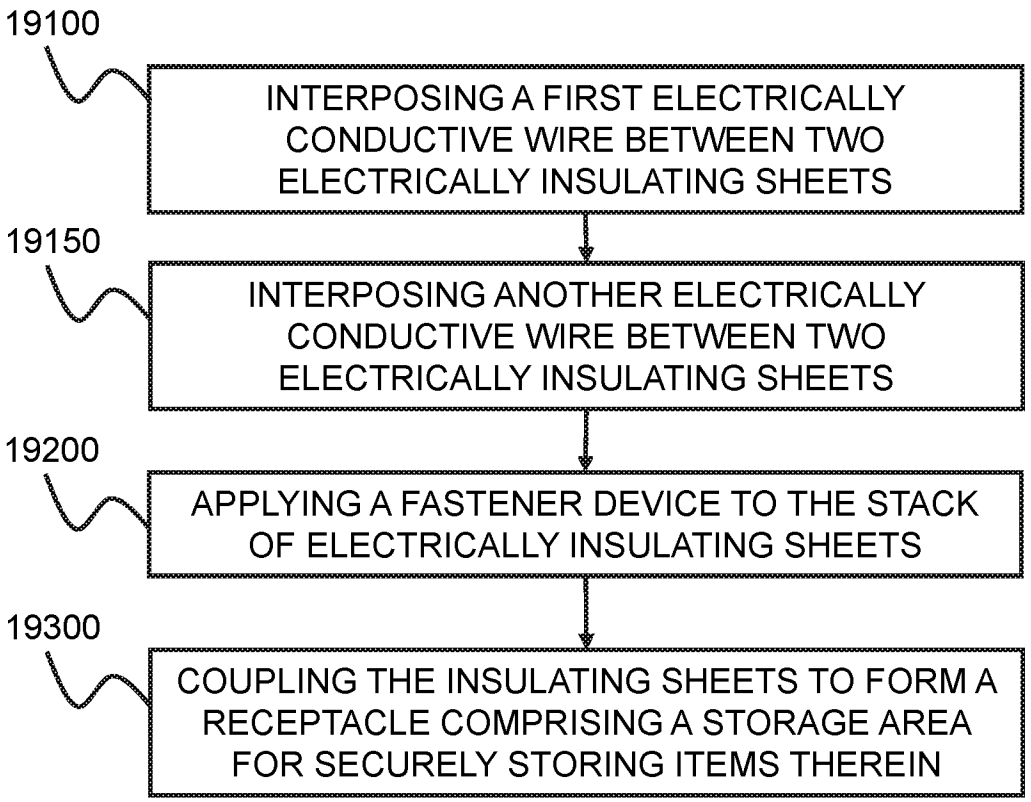

FIG. 1 is a schematic perspective illustration of a storage system comprising an item storage device, according to an embodiment;

FIG. 2A is a schematic front view illustration of the item storage device, according to an embodiment;

FIG. 2B is a schematic back view illustration of the item storage device, according to an embodiment;

FIG. 3A is a schematic front view illustration of an assembled lock mechanism and a storage device hanging hardware of the item storage device, according to an embodiment;

FIG. 3B is a schematic top view illustration of the item storage device, according to an embodiment;

FIG. 4 is a schematic perspective view illustration of a lock mechanism with its housing front cover removed, according to an embodiment;

FIG. 5 is schematic isometric view illustration of a storage system, according to another embodiment;

FIG. 6A is a schematic isometric view illustration of an item storage device and an item hanging hardware mechanism associated thereto, in an extracted (also: extended) configuration, according to an alternative embodiment;

FIG. 6B is a schematic side view illustration of the item storage device and the item hanging hardware mechanism associated thereto, in the extracted configuration, according to the alternative embodiment;

FIG. 6C is a schematic isometric view illustration of the item hanging hardware mechanism in a stowed (also: retracted) configuration, according to the alternative embodiment;

FIG. 6D is a schematic side view illustration of the item hanging hardware mechanism in the stowed configuration, according to the alternative embodiment;

FIG. 6E is a schematic isometric view illustration of the item hanging hardware mechanism in the extracted configuration, according to the alternative embodiment;

FIG. 6F is a schematic side view illustration of the item hanging hardware mechanism in the extracted configuration, according to the alternative embodiment;

FIG. 7A is a schematic plan view illustration of an alarm system of the item storage device and the alarm system's conductive pathways, according to an embodiment;

FIG. 7B is a schematic block diagram illustration of an alarm module of the alarm system, according to an embodiment;

FIG. 7C is a schematic block diagram illustration of a power module of the alarm module, according to an embodiment;

FIG. 8 show electric circuitry implementations of a charging module, a connector overvoltage and polarity protection; and a charging unit of a power module, according to an embodiment;

FIG. 9 show electric circuitry implementations of an accumulator and a shortcut and overdischarge protection of the power module, according to an embodiment;

FIG. 10A is a schematic block diagram illustration of a detection engine of the alarm module, according to an embodiment;

FIG. 10B is a schematic block diagram illustration of an output module of the alarm module, according to an embodiment;

FIG. 11A shows an electric circuitry implementation of a power management module of the item storage device;

FIG. 11B shows an electric circuitry implementation of a plug for a microswitch of the detection engine, according to an embodiment;

FIG. 11C shows an electric circuitry implementation of a buzzer module of the alarm module, according to an embodiment;

FIG. 11D shows an electric circuitry implementation of a light source of the alarm module, according to an embodiment;

FIG. 11E shows electric circuitry implementations of a light switch module, a detection unit, and a test button, according to an embodiment;

FIG. 12A is a picture of the front side of a first trace carrier sheet of the item storage device's receptacle, according to an embodiment;

FIG. 12B is a picture of the backside of the first trace carrier sheet, according to an embodiment;

FIG. 12C is a picture of the front side of a second trace carrier sheet, according to an embodiment;

FIG. 12D is a picture of the backside of the second trace carrier sheet, according to an embodiment;

FIG. 12E is a schematic backside view illustration of conductive paths comprised in a receptacle body, according to an embodiment;

FIG. 12F is a schematic front view illustration of conductive paths comprised in a receptacle body, according to an embodiment;

FIG. 12G is a schematic side view illustration of conductive paths comprised in a receptacle body, according to another embodiment;

FIG. 12H is schematic backside view illustration of conductive paths comprised in a receptacle body, according to another embodiment;

FIG. 12I is a schematic front view illustration of conductive paths comprised in a receptacle body, according to another embodiment;

FIG. 12J is a schematic side view illustration of conductive paths comprised in a receptacle body, according to another embodiment;

FIG. 13 is a schematic front plan view illustration of a fastener of the item storage device and the conductive pathways, according to an embodiment;

FIGS. 14A to 14D are schematic isometric view illustrations of embodiments of a frame structure;

FIG. 14E is a schematic isometric view illustration of the item storage device according to the embodiment of FIG. 5;

FIG. 14F is a schematic isometric view illustration of an item storage device, according to a yet alternative embodiment;

FIGS. 15A and 15B are schematic isometric view illustrations of form-shaping elements of a receptacle body, according to some embodiments;

FIG. 16A is an exploded view of a lock mechanism, according to some other embodiments;

FIG. 16B is an assembled view of the lock mechanism of FIG. 16A;

FIG. 16C is a view of the lock mechanism in an unlocked state;

FIG. 16D is a view of the lock mechanism in a locked state;

FIG. 17A is a schematic isometric illustration of an item storage device, according to a yet other embodiment;

FIG. 17B is a schematic isometric illustration of a tent comprising conductive pathways, according to some embodiments;

FIG. 18 is flow chart illustration of a method of using the storage system, according to an embodiment;

FIG. 19 is a flow chart illustration of a method of manufacturing the receptacle of the item storage device, according to an embodiment; and FIG. 20 a flow chart illustration of a method of manufacturing a receptacle of the item storage device, according to another embodiment.

DETAILED DESCRIPTION

The following description of devices, systems and methods for storing items (e.g., garment) is given with reference to particular examples, with the understanding that such systems and methods are not limited to these examples.

According to some embodiments, an item storage device for securely storing items may comprise a container or receptacle such as, for example, a garment bag. In some embodiment, the terminology "securely storing" as well as grammatical variations thereof may relate to a configuration in which access to the receptacle's storage area is, by design-intent, not intended to be enabled other than through unsecuring of the fastener and setting the fastener to open the receptacle without damaging or otherwise compromising the structural and/or functional integrity of the receptacle, the lock mechanism and/or the fastener for example, so that the operation of opening of the receptacle for removing an item therefrom is not properly reversible.

According to some embodiments, the receptacle may define a storage area for receiving an item, e.g., at a hanger by suspension, and comprise a fastener (e.g., a zipper) that may operably cooperate with a lock mechanism for selectively securing the fastener in a closed position and for unsecuring the fastener for allowing the fastener to be set from the closed into an open position. In the open position, the receptacle's storage area can be accessed by a user of the device for removing an item and/or placing an item therein for storage. The alarm system is operably coupled with the receptacle such to provide an alarm output responsive to detecting an attempt to forcefully gain access to the receptacle's storage area, e.g., responsive to detecting that the structural integrity of the receptacle is compromised.

According to some embodiments, the receptacle may comprise one or more conductive pathways running along the body of the receptacle, e.g., to form a mesh-like pattern matching or substantially matching the geometric structure of the receptacle's body. The conductive pathways may be operably comprised in an alarm system which provides an output in the event the structural integrity of one or more of the conductive pathways is compromised or damaged, e.g., due to an attempt to forcefully gain access to the receptacle's storage area rather than through authorized unsecuring of the lock mechanism and setting of the fastener from the closed in the open position. Such attempts may include, for example, rupturing and/or slicing of the receptacle; and/or breaking of the lock mechanism. According to some embodiments, portions of the conductive pathways may run and extend at least partially below two rows of teeth of a zipper which may embody the fastener.

According to some embodiments, the receptacle may be equipped with a storage device hanging hardware allowing non-removable suspension of the receptacle from a carrier bar.

According to some embodiments, a system for storing garment may include a suspension arrangement comprising the carrier bar and a plurality of item storage devices, each device including a receptacle which is non-removably coupled with the bar by their respective storage device hanging hardware. The terminology "non-removably coupled" as well as grammatical variations thereof may relate to a configuration in which the receptacle is, by design-intent, not intended to be removed from the carrier bar without, for example, damaging or otherwise compromising the structural and/or functional integrity of the carrier bar, the storage device hanging hardware and/or the receptacle and/or of the system as a whole. The non-removably coupling of the receptacle with the carrier bar may for example prevent disengaging of the receptacle from the carrier bar by manual force, unless for example brute force is applied and/or the disengagement is not properly reversible.

According to some embodiments, the device and/or the system may be operative to provide the user with an output (e.g., by light indication) which indicates or signals the user which one of the receptacles have an item stored therein and which not. For example, in case the fastener is secured in the closed position, a light indicator may be actuated for indicating that a given receptacle is in use, allowing the user of the system to identify and select a receptacle which is not in use, i.e., which does not store an item therein.

Referring to FIG. 1A, a system (also: storage system) for securely storing items such as, for example, valuables and/or garments, is herein referenced by alphanumeric label "100". Storage system 100 may comprise one or more item storage devices 200 which are configured to securely store items therein. The item storage devices 200 may be non-removably coupled with a carrier or carrier bar 101, e.g., of a rack 102, for example, via a storage device hanging hardware 210. Carrier bar 101 may extend in an essentially longitudinal direction, schematically illustrated by longitudinal axis Z. It is noted that rack 102 comprising carrier bar 101 may herein also be referred to as a "frame structure" 102. An axis Y is perpendicular to axis Z and points in a direction which about coincides with the weight applied by item storage device 200 onto storage device hanging hardware 210. An axis X be perpendicular to both axes Y and Z.

An item storage device 200 may comprise a fastener 220 and a lock mechanism 230 for selectively securing fastener 220 in a closed position and for unsecuring the fastener to allow it to be set in an open position. Lock mechanism 230 may for example be embodied by a mechanical system (e.g., manual and/or electrically driven), by an electronic or electrical system (e.g., electromagnetically operated and/or code-based keypad input) or by a hybrid, electro-mechanical lock mechanism. For example, lock mechanism 230 may be entirely manually operated (e.g., by a manually operable cylinder lock) or comprise an electromechanical drive that is operated responsive to receiving an input (e.g., via a keypad or by inserting a key into hybrid electromechanical cylinder lock). An electromechanical lock mechanism may be for example solenoid-based and/or a servo-based linear or rotary actuator. Optionally, lock mechanism 230 may be, for example, keypad-operated (e.g., operative to receive a code for authentication) and/or key-cylinder operated for selectively locking and unlocking lock mechanism 230. Optionally, unlocking and locking may be activated responsive to providing a biometric input, if authenticated.

Additional or alternative technologies that may be employed for selective locking and unlocking of lock mechanism 230 responsive to received and authenticated user identification information may include, for example, RFID; a machine-readable labels encoding information (e.g., a barcode, a matrix barcode); near-field communication (NFC); magnetic strip card; a mobile application of a mobile computerized end-user device (not shown) for communication with lock mechanism 230 (e.g., by employing Blue-Tooth™, Zigbee™ or any other wireless communication protocol or standard) for the remote and selective locking and unlocking of the lock mechanism, e.g., through a barcode, passcode, biometric input and/or the like provided from and/or via the mobile computerized end-user device; and/or one-wire technology. Optionally, an RFID chip encoding authentication information may be embedded into, e.g., an injection molded component. In some embodiments, a chip encoding unique user identification (ID) information may communicate with a processor or controller of lock mechanism 230 through 1-wire and/or any other MicroLan technology. For example, a first communication interface (not shown) of such MicroLan technology may be operably placed into a keyhole (or in any other user-accessibly arrangement) of lock mechanism 230. A second communication interface (not shown) operable to communicate with the first communication interface may be part of a button, key or any other user-component. The second communication interface may for example be comprised in an injection-molded key-shaped user component. If the second interface of such one-wire-based (e.g., key-shaped) user component is operably coupled by the user of the storage system with the first communication interface of the lock mechanism 230, and the ID information encoded in the chip of the user component is authenticated, lock mechanism 230 may be set, depending on the initial configuration, from the locked into the unlocked configuration, or from the unlocked to the locked configuration, e.g., through activation of an electromechanical mechanism, or by unblocking a rotation mechanism for allowing the turning of the key-shaped user component for the locking or unlocking of lock mechanism 230. Generally, authentication for verifying eligibility of a user to access (e.g., via biometric, key and/or code-based identification) an item storage device may be performed, for example, by an alarm module, which is referred to herein below in greater detail.

Generally, a mechanical system may also include pneumatic or hydraulic system.

In an embodiment, lock mechanism 230 may facilitate event logging and store, for example, timestamps of locking and unlocking events of lock mechanism 230.

In some embodiments, rack 102 may be fixedly installed at a venue, i.e., the rack 102 may be non-moveable. In some embodiments, item storage device 200 may comprise the alarm module (referred to herein below in more detail) which, responsive to detecting an attempt of forcefully accessing a storage area of the device, sets off an alarm. A personal item can thus be securely stored by the storage systems, e.g., in a publicly accessible space, as will be outlined herein below in more detail.

Merely to simplify the discussion that follows and, therefore, without being to be construed as limiting, item storage device 200 is schematically illustrated in the accompanying figures as a garment or cloth holder. Accordingly, the terms "receptacle", "garment bag" and "cloth holder bag" may be used interchangeably without conferring any limiting meaning to the term "receptacle" for example, unless otherwise stated explicitly.

Further referring to FIGS. 2A and 2B, an item storage device 200 for storing items such as valuables and/or garments, comprises a receptacle 201. Such item or items are herein referenced by alphanumeric designation "202" and is schematically illustrated as a jacket in dashed lines. Receptacle 201 may comprise a receptacle body whose inner surface or surfaces may define the boundaries of a storage area 203 which can be selectively exposed and concealed by setting or engaging fastener 220 to be in an open and closed position, respectively, as will be outlined herein below in more detail. The terms "receptacle" and "receptacle body" may herein be used interchangeably.

The receptacle may, for example, comprise a front panel 204A and a matching back panel 204B. In some embodiments, front panel 204A and back panel 204B may be joined with each other along their edges. Additionally or alternatively, front panel 204A and back panel 204B may be integrally formed with each other. In some embodiments, receptacle 201 may comprise a side panel 204C (FIG. 2B) which joins front and back panels 204A and 204B along their edges.

According to some embodiments, receptacle 201 may be lightweight and weigh less than, for example, 1 kg, 800 grams, 600 grams, 500 grams, 400 grams or 300 grams. Receptacle 201 may be made of any suitable material or materials such as, for example, synthetic polymer material (e.g., Kevlar®); natural polymer material (e.g., cotton) and/or metal. Material(s) of receptacle body may be resilient and rigid; resilient and semi-rigid; and/or resilient and slack. For example, front panel 204A may be made of a cloth-like and/or slack yet tear-resilient material, and back panel 204B may be made of a rigid and semi-rigid resilient material. In an embodiment, receptacle 201 may comprise a frame or skeleton structure 208 with material (e.g., fabric material) attached thereto to form the body of receptacle 201.

Additional reference is made to FIG. 3A. In some embodiments, receptacle 201 may be non-removably coupled with carrier bar 101. For example, frame structure 108 of receptacle 201 may be non-removably coupled with carrier bar 101. In an embodiment, frame structure 108 may constitute a part of housing 231 of lock mechanism 230. Such part (e.g., a top cover of housing 231) may be non-removably coupled with storage device hanging hardware 210 which, in turn, may be non-removably coupled with carrier bar 101.

A press-fit method and/or any other suitable method and/or configuration may be employed for the coupling of receptacle 201 with carrier bar 101. For instance, an enveloping first member 211 of storage device hanging hardware 210 may be thermally expanded, put over another, second coupling member (not shown) and thereafter be thermally contracted through cooling to achieve a tight fit between first member 211 and the second coupling member. Additionally or alternatively, a nut-thread connection may for example be employed.

In some embodiments, storage device hanging hardware 210 may comprise a slider coupling member 212 for slidably and non-removably coupling item storage device 200 onto carrier bar 101, e.g., in a suspended manner. In other words, item storage device 200 may for example be slidably suspended onto carrier bar 101. In an embodiment, slider coupling member 214 may be fixedly coupled with first member 211. In an embodiment, slider coupling member 212 and carrier bar 101 may be configured such to prevent rotating of storage device hanging hardware 210 around the bar's longitudinal axis Z in directions schematically illustrated by arrows M. For example, slider coupling member 212 may be form-fittingly coupled with carrier bar 101 such to prevent rotation in direction M while allowing sliding of sliding coupling member 212 along carrier bar 101 along direction Z. For example, slider coupling member 212 may comprise an annular body having an outer and inner surface 215A and 215B. Accordingly, merely to simplify the discussion that follows, without be construed as limiting, slider coupling member may herein with respect to some embodiments be referred to as "annular coupling member". Inner surface 215A of slider coupling member 212 may for example have a cross-sectional polygonal shape fittingly matching the outer cross-sectional shape of carrier bar 101 slidably engage with the bar's outer surface. Clearly, additional or alternative storage device hanging hardware 210 configurations may be conceived. For example, slider coupling member 212 may comprise a T-shaped body (not shown) which is slidably coupled in a suspending manner with a guide slot (not shown) formed in carrier bar 101.

Referring now to FIG. 3B, storage system 100 may be configured to limit rotational movement of item storage device 200 around axis Y, e.g., by employing a rotational stopper device (not shown) comprised in storage device hanging hardware 210. Rotational movement of item storage device 200 around axis Y may for example be limited such to traverse an angle $\alpha$ of maximum, e.g., 15°, 30°, 45 or 90°, relative to axis X in the X-Z plane. In another embodiment, rotational movement of item storage device 200 around axis Y may be unlimited, i.e., item storage device 200 may be rotatable by 360° or more in any direction around axis Y. Clearly, additional or alternative patterns may be envisaged. For instance, the orientation of a zigzag pattern may be tilted with respect to the X-Axis, e.g., as schematically illustrated in FIGS. 12G and 12H.

In an embodiment, storage device hanging hardware 210 may comprise a drive (not shown) for conveying receptacle 201 along carrier bar 101. In an embodiment, storage system 100 may comprise a controller (not shown) which is operably coupled with the drive for conveying a selected receptacle to a specific position along carrier bar 101. For example, each drive may be associated with a receptacle ID so that an operator of storage system 100 can enter the receptacle's ID into an interface. In response to entering the ID, the drive may be actuated and convey the corresponding receptacle 201 to a predetermined position along carrier bar 101. In an embodiment, system 100 may be operative to identify which one of all the receptacles are not in use and, responsive to a request issued by the operator, convey a receptacle which is not in use to a predetermined position along carrier bar 101. Such position may correspond to the operator's location of service.

According to some embodiments, storage system 100 may be operable to communicate with the mobile computerized end-user device (not shown) which may be associated with an owner of item 202 securely stored in item storage device 200. The owner may provide the operator of system 100 with an indication requesting item 202 soon to be handed over to the owner. Such indication may be received by the drive (e.g., manually via the operator or automatically) which, in response, may convey the corresponding receptacle to the given location of service.

A mobile computerized end-user device may include, for example, a multifunction mobile communication device also known as "smartphone", a personal computer, a laptop computer, a tablet computer, a personal digital assistant, a wearable device, a handheld computer, a notebook computer, a vehicular device and/or a stationary device.

Reverting to FIG. 3A, fastener 220 may be configured to be operably cooperate with lock mechanism 230 for selectively securing fastener 220 in the closed position and for unsecuring the fastener for allowing fastener 220 to be set from the closed into the open position. When unsecured, fastener 220 can be set into the open position so the receptacle's storage area 203 can be accessed by the user. In the secured position, fastener 220 may be interlockingly coupled with lock mechanism 230, e.g., as outlined herein.

According to some embodiments, fastener 220 may be embodied by a zipper mechanism. Merely to simplify the discussion that follows, and without be construed as limiting, the terms "zipper", "zipper mechanism" and "fastener" may be used interchangeably. Zipper mechanism 220 may comprise a puller 221 coupled with a glider 222 and two rows of teeth forming a zipper track 223. Glider 222 operably engages with the teeth of zipper track 223. The assembly formed by puller 221 and glider 222 may herein be referred to as "zipper car". As shown schematically in FIG. 2A, zipper track 223 may have a first and a second end, which may also be referred to as origin and terminus, respectively, and which may for example extend from a bottom section to a top section of front panel 204A or traverse otherwise at least partially some of front panel 204A. Zipper track 223 may divide front panel 204A into two partially reversibly separable right and left sides 205A and 205B for selectively allowing access to storage area 203. For example, fastener 220 may be set in closed position preventing access to storage area 203 when puller 221 abuts against the first end (e.g., the upper end) of the zipper track 223 and the two rows of teeth interlockingly engage with each other. Correspondingly, when puller 221 abuts against the second end (e.g., the lower end) of zipper track 223, the first and second rows of teeth may be disengaged from one another so that storage area 203 can be accessed for storing therein and/or removing therefrom an item.

In some embodiments, as shown in FIG. 3A and further in FIG. 4, lock mechanism 230 may be convertible to be set between a non-locking configuration for unsecuring fastener 220 and a locking configuration for securing fastener 220 in its closed position. Lock mechanism 230 may for example comprise a housing 231 which may be formed to include a recess 232 (e.g., in the form of a longitudinal slit) for removably receiving glider 222 which can be pulled into recess 232 by employing puller 221. Lock mechanism 230 may further comprise a retention element 233 (e.g., a latch or plunger) which may be operably coupled with a key receiving mechanism 234. Such key receiving mechanism 234 may comprise or be embodied by a latch drive. Merely to simplify the discussion that follows, without be construed as limiting, the terms "key receiving mechanism" and "latch drive" may be used interchangeably.

The key receiving mechanism or latch drive 234 may for example be embodied by a lock cylinder, e.g., as known in the art. Latch drive 234 may for example comprise a keyhole 235 for receiving a key 236 and/or may for example comprise a keypad (not shown) for receiving a code for engaging latch drive 234. In some embodiments, retention element 233 may be positionable relative to recess 232 between a retracted position and an extended position. Setting retention element 233 in the extended position by suitably engaging key 236, may cause activation (also: "arming") of an alarm system, as exemplified herein below in more detail. The alarm system may be selectively activated and deactivated respective of the item storage device for which a lock mechanism is properly set into a locking and non-locking configuration, e.g., as will be outlined herein in more detail. In other words, while for one item storage device the alarm system may be deactivated, the same alarm system may at the same time be in an activated mode for another item storage device.

Such extended position is exemplarily and schematically illustrated in FIG. 3A. Zipper track 223 may be aligned with and extend behind recess 232, relative to a front view perspective of fastener 220. In addition, zipper track 223 may be fixedly coupled to an inner portion of housing 231. Thus, when retention element 233 is in the retracted position, lock mechanism 230 may be in the non-locking configuration allowing, for example, glider 222 to be pulled into and out of recess 232 by puller 221. Conversely, in the locking configuration, retention element 233 may be in the extended position, form-lockingly secure puller 221 between retention element 233 and the boundaries of recess 232 so that glider 222 cannot be pulled out of recess 232. More specifically, in some embodiments, a portion of housing 231 may be positioned forward or bulge in direction of the normal of the front panel's outer surface so that retention element 233, when in extended position, overlays zipper track 223. Retention element 233, when in extended position, may thus prevent or block puller 221 from moving in reverse direction for opening the zipper. In some embodiments, puller 221 may be securely engageable with retention element 233. Clearly, additional or alternative implementations of lock mechanism 230 may be envisaged.

In an embodiment, latch drive 234 may be engaged by a key 236 e.g., by turning a matching key inserted in keyhole 235 of such latch drive 234. In an embodiment, latch drive 234 may be operably coupled with retention element 233, e.g., via a rotary-to-linear motion conversion mechanism, so that rotation of latch drive 234 causes linear displacement of retention element 233. For example, retention element 233 may be operably coupled with latch drive 234 via a lever member 237 having a slot 238 for slidably receiving a pin 239 of retention element 233, so that turning latch drive 234 in a first direction may cause retention element 233 to be pulled by lever member 237 within guide tracks 233A from the retracted into the extended position (shown in FIGS. 3A and 4). Conversely, by operably engaging (e.g., turning) latch drive 234, responsive to engaging key 236 with the drive 234) in a second direction may cause retention element 233 to be moved from the extended into the retracted position. Clearly, additional or alternative rotation-to-linear motion conversion mechanisms may be employed.

Further reference is made to FIG. 5, which schematically shows a storage system 5000, in assembled configuration, according to some other embodiments. Storage system 5000 comprises a plurality of item storage devices 6200 (e.g., each including a receptacle implemented, e.g., as a garment bag) configured to securely store items therein. Storage system 5000 may comprise a frame structure 5100 for securely and non-removably holding item storage devices 6200.

In one embodiment, storage system 5000 is configured such that item storage devices 6200 are reversibly and slidably displaceable in X-direction from a stowed into an extended position. For example, one or more item storage devices 6200 may be coupled to respective one or more storage device hanging hardware (not shown) that allows the slidable displacement of the one or more item storage devices 6200 in the X-direction, i.e., in forward direction. Optionally, the item storage devices 6200 are rotatable around the Y-Axis, e.g. once they are in the extended position. Optionally, the item storage devices 6200 are not rotatable around the Y-Axis, when in the extended position. Optionally, movement of item storage devices 6200 is fixed in Z-direction.

In another embodiment, which is outlined herein in more detail, item storage device 6200 may be fixedly and non-removably coupled with frame structure 5100 (e.g., to an upper frame structure (not shown)) of storage system 5000, e.g., by bolts 6209. A hanger 6240 (or any other coupling device such as a hook, loop, etc.) may be reversibly extractable out of the respective item storage device 6200. e.g., like a drawer, e.g., when the receptacle is properly opened. An item hanging hardware mechanism 6210 enables the reversibly extraction of hanger 6240 out of item storage device 6200 from a stowed configuration to an extracted configuration. Each item storage device 6200 may be operably engaged with its hanging hardware 6210. Item hanging hardware mechanism 6210 may be individually operable by their users. Moreover, the number of item storage devices 6200 and associated an item hanging hardware mechanism 6210 in storage system 5000 may be selectable. In other words, system 5000 is modular, e.g., at least with respect to the number of item storage devices 6200. It is noted that same principle can hold for storage device 100, i.e., storage device 100 is also modular.

Item hanging hardware mechanism 6210 may be non-removably coupled to frame structure 5100. Item hanging hardware mechanism 6210 may for example be implemented as a telescopically extendable mechanism (e.g., a telescopic arm system). Exemplarily, a first element 6211 of the telescopically extendable mechanism is fixedly coupled with frame structure of storage system 5000, and further elements (e.g., elements 6212-6213) are slidably extractable, e.g., as schematically shown in FIGS. 6A to 6F. In some embodiments, an item hanging hardware mechanism 6210 may comprise a plurality of linked extendable telescopic mechanisms (not shown) for the simultaneous extraction thereof. In some embodiments, each item storage device 6100 may comprise two or more independently operable an item hanging hardware mechanism 6210. In some embodiments, item hanging hardware mechanism 6210 may comprise a handle 6214 to facilitate extraction of hanger 6240 by the user through the pulling thereof. FIG. 5 shows hanging hardware 6210 of an item storage device 6200 in a stowed configuration. FIG. 6A is a schematic isometric illustration of an item storage device 6200 and a corresponding an item hanging hardware mechanism 6210 in an extracted configuration. FIG. 6B is a schematic side-view illustration of item storage device 6200 of FIG. 6A in the extracted configuration.

FIG. 6C is a schematic isometric illustration of an item hanging hardware mechanism 6210 in stowed configuration and FIG. 6D is a schematic side view illustration of an item hanging hardware mechanism 6210 in stowed or retracted configuration. FIG. 6E is a schematic isometric illustration of an item hanging hardware mechanism 6210 in extracted configuration and FIG. 6F is a schematic side view illustration of an item hanging hardware mechanism 6210 in extracted configuration.

Further reference is now made to FIGS. 7A to 7C. Storage system 100 may comprise an alarm system 300 which provides an indication in an event of unauthorized attempt to remove item 202 from receptacle 201. Alarm system 300 may be set in an idle mode or an activated mode. When in activated or armed mode, alarm system 300 provides an alarm output responsive to detecting an attempt of unauthorized access to the storage area of receptacle 201. For instance, in the activated mode, responsive to detecting that the structural integrity of receptacle is compromised, alarm system 300 may provide an alarm output. When in the idle mode, alarm system 300 is "disarmed".

In an embodiment, alarm system 300 may comprise an alarm module 400 and one or more conductive pathways 320 operably coupled with alarm module 400 and which run along the body of receptacle 201. Optionally, conductive pathways 320 may be arranged (e.g., in a vertical or horizontal pattern) and coupled to only one insulating sheet that is sandwiched between insulating sheets of the receptacle. Optionally, conductive pathways 320 may be arranged on two or more insulating sheets sandwiched between corresponding insulating inner and outer insulating sheets.

e.g., to form a mesh-like pattern matching the geometric structure of the receptacle's body. Conductive pathways 320 may be operably coupled with alarm module 400 which provides an output in the event the structural integrity of one or more of the conductive pathways 320 is compromised or damaged, e.g., due to an attempt to gain access to the receptacle's storage area 203 other than through authorized unsecuring of lock mechanism 230 and setting thereafter fastener 220 from the closed in the open position. Such attempts may include, for example, rupturing and/or slicing of receptacle 201. In some embodiments, receptacle 201 may also comprise, motion detectors (not shown) and/or light intensity sensors (not shown) inside of receptacle 201 capable of converting corresponding physical stimuli into processable electronic data. Responsive to sensing physical stimuli exceeding a predetermined threshold indicative of motion and/or light in storage area 203, an alarm may be set off by system 100.

It is noted that alarm module 400 is merely for exemplary purposes, without be construed as limiting, illustrated as being comprised in lock mechanism 230. Accordingly, components of alarm system 300 may be implemented differently and may, for example be comprised in storage device hanging hardware 210 and/or receptacle 201.

In an embodiment, alarm module 400 may comprise a memory 410 and a processor 420, a detection engine 430, an output module 440, and a power module 450 for powering the various components and/or modules of alarm module 400. The various components of alarm module 400 may communicate with each other over one or more communication buses (not shown) and/or signal lines (not shown). Alarm module 400 may for example be realized by one or more hardware, software and/or hybrid hardware/software modules, e.g., as outlined herein.

According to some embodiments, memory 410, may include one or more types of computer-readable storage media. Memory 410 may for example include transactional memory and/or long-term storage memory facilities and may function as file storage, document storage, program storage, or as a working memory. The latter may for example be in the form of a static random access memory (SRAM), dynamic random access memory (DRAM), read-only memory (ROM), cache and/or flash memory. As working memory, memory 410, may, for example, process temporally-based instructions. As long-term memory, memory 410, may for example include a volatile or non-volatile computer storage medium, a hard disk drive, a solid state drive, a magnetic storage medium, a flash memory and/or other storage facility. A hardware memory facility may for example store a fixed information set (e.g., software code) including, but not limited to, a file, program, application, source code, object code, and the like.

The term "processor" as used herein may additionally or alternatively refer to a controller. Processor 420 may for example relate to various types of processors and/or processor architectures including, for example, embedded processors, communication processors, graphics processing unit (GPU)-accelerated computing, soft-core processors and/or embedded processors.

Power module 450 may for example comprise a chargeable battery, a non-chargeable battery and/or an interface for receiving power from an electric grid. Power module 450 may for example comprise a battery (or accumulator) included in housing 231 of lock mechanism 230.

Memory 410 may include instructions which, when executed by processor 420, may result in detection engine 430. In an embodiment, detection engine 430 may control output module 440 and/or power module 450.

In one embodiment, each item storage device may be operably coupled with its own alarm module 400, i.e., the number of item storage devices may be equal the number of alarm modules. In another embodiment at least two or all item storage devices of a storage system may be operably coupled with alarm module 400. It is noted that the embodiments outlined herein with respect to alarm module 400 may be employed in any embodiment of storage system and/or item storage device disclosed herein.

The terms "engine" and "module" as used herein may refer to or comprise one or more computer modules, wherein a module may be a self-contained hardware and/or software component that interfaces with a larger system. Such module may be embodied by a circuitry and/or a controller programmed to cause storage system 100 to implement the methods, processes and/or operations as disclosed herein.

In an embodiment, detection engine 430 may control power module 450 to cause electric current to flow in conductive pathways 320. Moreover, detection engine 430 may be configured to detect, responsive to a change in an electrical parameter relating to electric current (ranging for example from 0.02 mA to 0.05 mA) flowing in conductive pathways 320 whether they have been damaged. Damaging of conductive pathways 320 may for example be result of tearing and/or cutting the body of receptacle 201. Responsive to the detection of a change in a parameter relating to electric current flowing in conductive pathways 320 output module 440 may set off an alarm, e.g., in the form of an audible output. The audible indication may thus be indicative to user of system 100 that receptacle 201 was forcefully opened (e.g., a cut was made into the body of receptacle 201). For example, responsive to a drop in electric current flowing between two terminals of an electrically conductive trace to zero current, detection engine 430 may cause output module 440 to provide an alarm.

A first electrically conductive trace may be interposed between two insulating sheet layers and arranged on a first trace carrier sheet, and a second electrically conductive trace may be arranged on a second trace carrier sheet and also interposed between two insulating sheet layers. Optionally, the same insulating layer may insulate the electrically conductive trace of one carrier sheet from the electrically conductive trace that is arranged on another carrier sheet. Optionally, an electrically conductive trace may be interposed between insulating layers without the employment of a trace carrier sheet. A first electrically conductive trace may comprise two or more physically separate trace portions.

In an embodiment, detection engine 430 may be operably coupled with motion detectors (not shown) and/or light intensity sensors (not shown) for sensing motion and light intensity in storage area 203. Responsive to sensing motion and/or light in storage area 203, detection engine 430 may cause an alarm to be set off.

Referring now to FIG. 7C, power module 450 may comprise a charging plug module 451, a connector overvoltage and polarity protection module 452 for protecting an accumulator 454, a charging unit 453 for charging accumulator 454, and a shortcut and overdischarge protection module 455 for circuitry in item storage device 200. FIG. 8 schematically illustrates example electric circuitry for implementing charging module 451, connector overvoltage and polarity protection module 452, and charging unit 453.

FIG. 9 schematically illustrates example electric circuitry for implementing accumulator 454 and short and overdischarge protection module 455.

Referring to FIG. 10A, detection engine 430 may comprise a power management module 431, a microswitch 432, a detection unit 433, and a test button 434. Microswitch 432 may be employed for selectively activating and deactivating alarm system 300, e.g., responsive to correspondingly engage key 236 with key receiving mechanism 234. For example, by turning a key in, or engaging a key card or biometric indicia (e.g., a fingerprint) with key receiving mechanism 234. For example, when microswitch 432, an electric circuit may be closed, activating alarm system 300. When activated, alarm system 300 is configured to set off an alarm responsive to detecting an attempt to forcefully gain access to storage area 203.

In an embodiment, microswitch 432 may activate a light source 442 (cf. FIG. 3A) which may be comprised in output module 440. In an embodiment, light source 442 may be positioned on first member 211 of storage device hanging hardware 210. Light source 442 may indicate, for example, with a first light (e.g., a green LED) when there is no item held in receptacle 201, i.e., item storage device 200 is available, and conversely, indicate, for example, with a second light (e.g., a red LED) when receptacle 201 is occupied by an item.

Further referring to FIG. 10B, output module 440 may comprise a buzzer module 441, light source 442, and a switch (not shown) for light source 443. As already mentioned herein, light source 442 may provide an indication whether an item is stored in receptacle 201. For instance, light source 442 may be responsively coupled with a hanger held in receptacle 201. Additionally or alternatively, light source 442 may be responsively coupled with drive 234 for example for indicating whether receptacle 201 is locked or not. Light source 442 not operating may indicate that accumulator 454 (also: power storage) requires charging or that light switch module 443 for light source (FIG. 11E below) is set to off. In an embodiment, operation of light source 442 may be disabled by light switch module 443. In some embodiments, a light source may be implemented by a same LED that can switch between different colors. Alternative to the microswitch, a proximity sensor may be employed (further details are outlined herein with respect to FIGS. 16A and 16B) may that gives off a signal when covered within a certain distance by for example by a retention element upon closing, signaling the electronics or processor to switch the light from green to red o when uncovered again vice versa.

FIG. 11A schematically illustrates example electric circuitry for implementing power management module 431; FIG. 11B schematically illustrates example electric circuitry implementing microswitch 432; FIG. 11C schematically illustrates example electric circuitry implementing buzzer module 441; FIG. 11D schematically illustrates example electric circuitry implementing light source 442; and FIG. 11E schematically illustrates example electric circuitry implementing detection unit 433, test button 434, and light switch module 443.

In an embodiment, alarm module 400 may comprise an electrical energy storage device (e.g., a capacitor) which is configured to ensure that alarm module 400 meets requirements relating to electromagnetic compatibility.

Referring now to FIGS. 12A to 12F, receptacle 201 may comprise a plurality of electrically insulating sheets 250. Conductive pathways 320 may comprise at least two conductive traces that are electrically insulated from one another by such electrically insulating sheets 250 of receptacle 201. For example, as shown in FIGS. 12A and 12B, a first electrically conductive trace 321A, which may optionally be arranged on a first trace carrier sheet 251, may be interposed between a first and second insulating sheet 252A and 252B. Further, as shown in FIGS. 12C and 12D, a second electrically conductive trace 321B, which may optionally be arranged on a second trace carrier sheet 253, may be interposed between second and third insulating sheet 252B and 252C. In other words, receptacle 201 may for example comprise a plurality of electrically insulating sheets for carrying at least two conductive traces that are electrically insulated from another by interposing them between insulating sheets. Accordingly, receptacle 201 may comprise an alternating and stacked arrangement of trace carrier sheets and insulating sheets in which each trace carrying sheet is interposed between two insulating sheets.

As exemplified in FIGS. 12A to 12D, first and second conductive traces 321A and 321B may be arranged to delineate, in combination, for example, a substantially grid- or mesh-like structure or pattern. In an embodiment, first electrically conductive trace 321A may extend between one carrier sheet edge 206A and an opposite sheet edge 206B of a first trace carrier sheet 251. Second electrically conductive trace 321B may extend between two opposite edges 207A and 207B of second carrier 253 which may be perpendicular to the edges of first trace carrier sheet 251. Accordingly, first conductive trace 321A may have a "vertical" direction or orientation, whereas second conductive trace 321B may have a "horizontal" orientation.

In some embodiments, first and second conductive traces 321A and 321B may be arranged in a serpentine-like manner. For example, first electrically conductive trace 321A may comprise first long path sections 322A and relative short first curved sections 323A extending from the long path sections 322A. Similarly, second electrically conductive trace 321B may comprise second long path sections 322B and relative short second curved sections 323B.

In an embodiment, first long path sections 322A may be arranged relative to second long path sections 322B to delineate, in combination, a mesh-like pattern. For example, the orientation of first long path sections 322A may be about 90 degrees relative to the orientation of second long path sections 322B.

In another embodiment, front panel 204A and back panel 204B may each comprise at least two conductive traces which may be arranged to delineate for instance, when viewed in combination, a mesh-like pattern. Clearly, different mesh-like structures than those exemplified herein may be conceived. For instance, each long portion may longitudinally extend in a waveform-like pattern between two opposite sheet edges.

Further reference is made to FIGS. 12E-12F. In some embodiments, one or more conductive pathways 320 may be coupled and extend in a zigzag pattern with a series of alternating turns (also: transitions) only to one insulating sheet that is sandwiched between an inner and an outer insulating sheet of the body of the item storage device. For example, an electrically conductive trace may be arranged to comprise alternating zigzag segments and extend from the top to the bottom end of the insulating sheet comprised in item storage device 6200. As for any of the embodiments disclosed herein, conductive pathway may be coupled, e.g., by sewing and/or gluing thereof onto the insulating sheet.

Optionally, the individual alternating segments forming the Zigzag pattern of conductive pathways 320 may be arranged such to form an angle $\alpha$ that is, for example, less than 90°, less than 45° or less than 30°, relative to the X-axis, as shown schematically in FIGS. 12E and 12F. The zigzag arrangement may be configured as two or more zigzag paths 6225 (e.g., zigzag paths 6225A and 6225B) extending from the top to the bottom section of the insulating sheet, e.g., such that the zigzag paths have an at least partially overlapping or interposing portion 6223. Referring to FIG. 12F, the conductive pathway may be comprised (e.g., in the zigzag path) in left and right sides 205A and 205B of front panel 204A as respective zigzag paths 6225C and 6225D. Optionally, zigzag arrangement may form, at back panel 204B, only one zigzag path. Optionally, zigzag arrangement may form, at back panel 204B, more than two zigzag paths. Optionally zigzag arrangement may be configured to form more than two zigzag paths with respect to the front panel's right and/or left sides 205A and 205B. Optionally, different conductive pathways may be employed for the front panel, back panel and the side panel. Optionally, the same conductive pathways may extend in the zigzag arrangement in the front, back and side panel. The zigzag arrangement of the conductive pathways in the side panel is schematically shown in FIG. 12G. According to some embodiments, the spatial density of the zigzag pattern may, for example, at least 4, 5, 6, 7, 8, 9 or 10 zigzag periods per 1 meter of height of item storage device 200 and/or 6200. Same spatial densities may be applied for vertically and/or horizontally, mesh-like, and/or similar thread patterns.

In some embodiments, conductive pathways 320 may be arranged on and coupled to a plurality of insulating sheets sandwiched between corresponding outer and inner insulating sheets and arranged, e.g., in a zigzag pattern to form, in combination, a mesh-like pattern for example.

Additional reference is made to FIG. 13. The features outlined herein with respect to FIG. 11 can be implemented for any thread pattern and item storage device disclosed herein (e.g., item storage device 200 and 6200), e.g., including the above described zigzag pattern. Therefore, while the following embodiments are outlined with respect to storage system 100, this should by no means construed in a limiting manner. As shown schematically in FIG. 13, zipper track 223 may be coupled (e.g., sewing or gluing) with first and second side 205A and 205B of front panel 204A by a pair of respective first and second covering tapes 224A and 224B extending from the zipper track's lower to the upper end. First tape 224A of the pair of stripes may extend along one side of zipper track 223 and second tape 224B may extend along the other side of zipper track 223. According to some embodiments, portions of the conductive traces proximal to zipper track 223 may be arranged between the outer surface of front panel 204A and underneath tapes 224A and 224B, schematically illustrated by dashed lines. According to some embodiments, portions of conductive traces may extend from either side of zipper track 223 below the teeth. For example, as is illustrated schematically in FIG. 13, portions of first electrically conductive trace 321A and second conductive trace 321B may extend underneath a first row of teeth of zipper track 223 from one separable right side 205A. Further, portions of first electrically conductive trace 321A and second electrically conductive trace 321B may extend underneath a second row of teeth from the other separable left side 205B. Optionally, portions of conductive traces may extend from either side of zipper track 223 such that the turning portions proximal to the teeth are aligned with the origin of the bases of the teeth, i.e., from a top view, the turning portions of the electrically conductive traces may abut against the teeth.

In some embodiments, one or more conductive traces other than the first and second electrically conductive traces 321A and 321B may for example extend under the teeth of first portion 205A.

As already outlined herein the same arrangement may be implemented for the zigzag pattern. For instance, transitions between segments of the zigzag or serpentine pattern formed by conductive paths proximal the zipper track may be arranged between the outer surface of front panel 204A and underneath tapes 224A and 224B, schematically illustrated by dashed lines. According to some embodiments, portions of conductive traces may extend from either side of zipper track 223 below the teeth.

In an embodiment, a third and fourth electrically conductive trace (not shown), electrically separate from the first and second electrically conductive traces, may be arranged between the teeth of zipper track 223 and a sheet (e.g., the outermost sheet) respective of first and second separable right and left sides 205A and 205B. For example, the third electrically conductive trace (not shown) may be interposed between tape 224A and the first row of teeth; and the fourth electrically conductive trace (not shown) may be interposed between tape 224B and the other, second row of teeth. In an embodiment, teeth may consist of electrically insulating material.

In an embodiment, conductive pathways 320 may be electrically insulated from the teeth of the zipper mechanism.

Further reference is made to FIGS. 14 to 14F. According to some embodiments, frame structure 5100 may comprise an upper frame structure 5102, and a bottom frame structure 5104, which are connected with each other by a left support structure 5106 and a right support structure 5108. The terms "right" and "left" refer to a viewing direction towards the front of storage system 5000. Frame structure 5100 may be configured to bear a suspending load of, e.g., up to 200 kg, 250 kg, 300 kg, 350 kg, 400 kg, 450 kg, 500 kg, 550 kg, 600 kg, 650 kg, 700 kg, or up to 1000 kg before the frame structure becomes permanently deformed.

Generally, system 100 and storage system 5000 may hold, e.g., at least 10, 11, 12, 13, 14, 15, 16, 17, 18, 19 or at least 20 item storage devices 200 and/or 6200.

FIG. 14A schematically shows frame structure 5100 with no further elements. In an embodiment, storage systems 100 and 5000 can be modularly extendable by allowing the juxtaposing (and optionally the coupling) of two or more corresponding frame structures to one another. FIG. 14B shows frame structure 5100 with left support structure 5106 and right support structure 5108 covered by panels 5107 and 5109, respectively. FIG. 14C schematically shows frame structure 5100 with panels 5107 and 5109 and wheeled assemblies 5110 such as castors to facilitate movement or transportation of system 100 and/or system 5000. FIG. 7D schematically shows a front view of lock panel 6231 of a lock mechanism 6230 of storage system 5000. Lock panel 6231 may be attached to the upper front end of frame structure 5100. FIG. 14E schematically shows storage system 5000 according to some embodiments. FIG. 14F schematically shows storage system 5000 according to some other embodiments. In the embodiments shown in FIG. 14F, storage system 5000 comprises a top panel 5112 for the roofing of frame structure 5100, e.g., to protect item storage devices 6200 from rain, snow and/or other environmental factors. Optionally, top panel 5112 may extend such to provide users standing in front, behind and/or at the sides of storage system 5000 cover from rain, snow, sunlight etc.

In FIG. 14F, storage system 5000 is further shown with a lock mechanism 6230. Lock mechanism 6230 may be attached to frame structure 5100 via front panel 5111. FIG. 14F further shows storage system 5000 with a plurality of service sites 5113 (comprising, e.g., lockers and/or charging stations for mobile devices). Service sites 5113 may be attachable to or juxtaposed to the outer left and/or outer right wing of frame structure 5100. Optionally, storage system 5000 may comprise a hood (not shown) that includes a screen displaying information to passers-by and/or users of storage system 5000. The information may include, for example, the number of item storage devices that are not occupied/currently not in use; public transportation information, advertisement (which may be location-based), a show program, newsfeeds, live feeds from a performance showing at the venue that is served by the system; a list of upcoming shows, etc.

Additional reference is made to FIG. 15A. According to some embodiments, a garment bag 6201 may comprise a form-shaping element 6250 to ensure that garment bag 6201 retains its shape, does not wrinkle and/or deform, and/or to facilitate the opening and closing of garment bag 6201 through the operable engagement of puller 221 of zipper mechanism 220. In an embodiment, form-shaping element 6250 comprises a rectangular-shaped plate. In an embodiment, form-shaping element 6250 comprises a rectangular-shaped frame, i.e., annular rectangle body, to provide an opening 6251. Rectangular-shaped plate and/or annular rectangle body 6250 may be sized according to the dimensions of a bottom of garment bag 6201, e.g., such that rectangular-shaped plate and/or annular rectangle body 6250, when placed inside the bag and on the bottom thereof, snug fits the dimensions of the bag's bottom. Due to weight imparted by rectangularly shaped plate and/or annular rectangle body 6250, the shape of garment bag 6201, whose receptacle body may for example be made of cloth-like and/or slack yet tear-resilient material, may be retained. Moreover, the weight imparted by the rectangular shaped plate and/or annular rectangle body 6250 prevents the receptacle body to be pulled up due to the pulling up of puller 221 of zipper mechanism 220. It is noted that in some embodiments, rectangularly shaped plate and/or annular rectangle body 6250 may be coupled to the outside of the bottom of garment bag 6201. Opening 6251 of annular rectangle body 6250 allows garment bag 6201 to air out. Rectangular-shaped plate and/or annular rectangle body 6250 may be fastened to garment bag 6201 by fasteners including, for instance, threads, Velcro™, adhesives, and/or bolts.

Clearly, rectangular-shaped plate and/or annular rectangle 6250 may also be employed by item storage device 200 of system 100. Moreover, the form-fitting elements may have alternative polygonal shapes to snug fit correspondingly shaped bottoms of receptacles.

Further reference is made to FIG. 15B. According to some embodiments, form-shaping element may be coupled with frame structure 5100. The below features are outlined with respect to form-shaping element 6250 implemented as an annular rectangular body 6250, yet this should by no means be construed limiting. Accordingly, the below features may be also be applied with respect to form-shaping element 6250 implemented as a rectangular plate.

In an embodiment, annular rectangle body 6250 may be removably coupled to bottom frame structure 5104. Optionally, annular rectangle body 6250 may be placed onto to the inside bottom of garment bag 6201. Optionally, annular rectangle body 6250 may be fastened to the inside bottom of garment bag 6201. The bottom of garment bag 6201 may be coupled to bottom frame structure 5104, e.g., as outlined herein below. Bottom frame structure 5104 may comprise two or more loops 5105 to which the bottom of garment bag 6201 can be removably coupled. Optionally, loops 5105 are positioned opposite each other, in substantial alignment with proximal end portion 6260 and distal end portion 6270 of garment bag 6201. For example, proximal end portion 6260 of garment bag 6201 may be coupled to a first loop 5105A of frame structure 5100, and distal end portion 6270 of garment bag 6201 may be coupled to a second loop 5105B. For example, Velcro™ tapes (which may optionally be elastic), which may be sewn to proximal and distal end portions 6260 and 6270 outside the bottom of garment bag 6201, may be strapped around loops 5105A and 5105B. In an embodiment, loops 5105 may be integrally formed with or pre-cut into bottom frame structure 5104.

Reference is made to FIGS. 16A to 16D, which schematically illustrate a lock mechanism 6230 of storage system 5000. Lock mechanism 6230 may include lock panel 6231 (also shown in FIGS. 14D and 14E) that may be attached to the upper front end of frame structure 5100. Lock mechanism 6230 may further comprise a recess 6232 (e.g., in the form of a longitudinal slit) for removably receiving glider 222 of zipper mechanism 220 which can be pulled into recess 232 by employing puller 221. Lock mechanism 6230 may further comprise a retention element 6233 (e.g., a latch or plunger) which may be operably coupled with a key receiving mechanism, keypad mechanism and/or any other latch drive 6234. Latch drive 6234 may for example comprise a keyhole for receiving a key and/or may for example comprise a keypad for receiving a code for the operable engagement of latch drive 6234 for selectively setting lock mechanism 6230 in the locking or non-locking configuration.

Retention element 6233 may be positionable relative to recess 6232 between a retracted (also: locked) position (FIG. 16C) and an extended (also: unlocked) position (FIG. 16D). Setting retention element 6233 in the locked position by suitably engaging key 236, may cause individual activation (also: "arming") of an alarm system, e.g., as already exemplified herein, of certain item storage devices 200 and/or 6200. In other words, alarm system 300 may be configured so that an item storage device (e.g., comprised in storage system 100 and/or storage system 5000 disclosed herein) can be individually and controllably armed. For example, detection engine 430 may be operative to detect which one of the item storage devices comprised in the storage system has been properly unlocked or locked, and responsively cause deactivation or activation of the alarm system of the corresponding item storage device accordingly.

It is noted that in some embodiments, alarm system 300 may be set in three or more different operation modes. In a first operation mode (fully deactivated mode), alarm system 300 may be completely deactivated, i.e., alarm system 300 may neither detect the cutting and/or tearing of the body of any receptacle (also: any item storage device such as, e.g., a garment bag) comprised in the storage system, nor whether a lock mechanism operably coupled with a given receptacle is properly locked or unlocked. In a second operation mode (partially activated mode), alarm system 300 may be operative to detect the cutting and/or tearing of the body of any receptacle, even when the lock mechanism is in the unlocked configuration (e.g., when retention element 6233 is in the unlocked position). In a third operation mode, alarm system 300 may be operative to detect the cutting and/or tearing of the body of any receptacle, as well as attempts of improper unlocking of the lock mechanism.

In some embodiments, zipper track 223 may be aligned with and extend behind recess 6232, relative to a front view perspective of zipper mechanism 220. In the non-locking configuration, causing retention element 6233 to be in the unlocked position, and glider 222 can be pulled into and out of recess 232 by puller 221. Conversely, in the locking configuration, retention element 6233 may be in the locked position, form-lockingly secure puller 221 between retention element 6233 and the boundaries of recess 232 so that glider 622 cannot be pulled out of recess 6232. In some embodiments, a portion of lock panel 6231 may be positioned forward or bulge in direction of the normal of the front panel's outer surface so that retention element 6233, when in extended position, overlays zipper track 223. Retention element 6233, when in extended position, may thus prevent or block puller 221 from moving in reverse direction for opening the zipper. In some embodiments, puller 221 may be securely engageable with retention element 6233. Additional or alternative implementations of lock mechanism 6230 may be envisaged.

In an embodiment, latch drive 6234 may be operably coupled with retention element 6233, so that operable engagement of latch drive 234 causes displacement of retention element 6233. For example, retention element 6233 may be operably coupled with latch drive 6234 with an electro-mechanical and/or electromagnetic drive mechanism so that operably engaging latch drive 6234 for securing in a locked configuration may cause retention element 6233 to be set from the unlocked into the locked position, e.g., causing retention element 6233 to slide through guide tracks 6239 of lock panel 6231 to form a closed frame that form-lockingly secures puller 221 between retention element 6233 and the boundaries of recess 6232. Conversely, by operably engaging latch drive 6234 to unlock lock mechanism 6230 may cause retention element 6233 to be moved from the locked into the unlocked position, e.g., including the guiding of retention element 6233 out of guide tracks 6239.

Assembly 6235 refers to an LED PCB board, which can comprise one or more (e.g., LED) lights able to emit, e.g., both red and green light, and a proximity sensor (e.g., implemented optically) that is able to detect whether a physical object is covering the sensor within a certain distance of, e.g., 5 mm. In an embodiment, assembly 6235 is positioned such that when the receptacle is opened, retention element 6233 is in retracted position in which it does not cover the optical sensor on the PCB board. Conversely, when the lock mechanism is set into the closed configured, retention element 6233 is set from the rotated to the extended position (e.g., by rotation of about 90 degrees downwardly), and covers the optical sensor. Responsive to detecting the covering of the optical sensor by retention element 6233, the proximity sensor emits a signal that switches the light indication from green to red. When the lock mechanism is opened, retention element 6233 retracts, uncovering the proximity sensor, causing the light indication to switch from red to green. In one embodiment, uncovering the proximity sensor may cause deactivation of alarm system 300, and covering the proximity sensor may cause activation of alarm system 300 to become activated (e.g., causing power module 450 to apply a voltage to cause the flow of electric current in the conductive pathways). In some other embodiments, the alarm system may remain activated even when the retention element is properly set into the retracted position. In any case, assembly 6236 provides an occupancy status (e.g., green—free; red—occupied), i.e., assembly 6236 may herein also be referred to as "an occupancy indicator".

In an embodiment, assembly 6236 may be a power status indicator implemented, e.g., by an LED PCB board. The power status indicator may for example provide different light indications for any one of the following scenarios: when the battery is fully charged (e.g., green light indication); if the storage system is or is not plugged into a socket of an electric grid (e.g., yellow light indication for indicating that storage system is plugged it); when the battery is charging (e.g., blue light indication); when battery power is below a threshold indicating imminent depletion; and/or malfunctioning of storage system (e.g., broken bag, broken lock mechanism, battery not functioning, and/or the like). When the storage system is running on battery, the green light indication may be blinking.

As schematically shown in FIGS. 16A-16D, lock mechanism 6230 may comprise a U-shaped element or block element (also: drop down profile) 6237 that is slidably coupled to lock panel 6231 in alignment with recess 6232 such to allow vertical movement thereof (e.g., only one degree of freedom), as is schematically shown in FIGS. 9C-9D by arrows $V_{up}$ and $V_{down}$. Slidably coupled U-shaped element 6237 functions as a safety mechanism that prevents the activation of alarm system 300 for the respective garment 6201 bag, unless the zipper car (comprising puller 221 and glider 222) is properly pulled up, e.g., into recess 6232. More generally, the safety mechanism prevents the activation of alarm system 300, e.g., for the respective garment bag 6201 (or any other storage device for that purpose), unless the zipper mechanism is properly closed.

If such safety mechanism was not employed, alarm system 300 may be set into the activated mode or armed, and lock mechanism 6230 may be set in the locked configuration), so that alarm system 300 may falsely indicate that the garment bag is secured, while this is, in fact not the case, since the zipper mechanism 220 is not properly closed (i.e., the zipper car is not properly pulled into recess 6232). Hence, garment bag 6201 can be opened because the zipper car is positioned below retention element 6233.

When the zipper car is not properly pulled into recess 6232, U-shaped element 6237 is by default, e.g., through gravitation or by a drive mechanism (not shown), set in a blocking position (FIG. 16C) in which U-shaped element 6237 blocks the passage through guide tracks 6239, thus preventing retention element 6233 from moving through guide tracks 6239 from the unlocked to the locked position. In the blocking position, U-shaped element 6237 may for example rest or be forced against a stopper (e.g., on a lower edge or shoulder 6260) of lock panel 6231, and alarm system 300 may indicate that the corresponding item storage device is unlocked (e.g., by activating a respective green LED and deactivation of a respective red LED).

When the zipper mechanism is properly closed, e.g., when the zipper car is properly pulled into recess 6232, U-shaped element 6237 is pulled up (arrow $V_{up}$), e.g., by a drive mechanism (not shown) or by the user pulling the zipper car upwardly, causing guide tracks 6239 to become unblocked, which in turns allows retention element 6233 to pass through guide tracks 6239. Optionally, when the zipper mechanism (e.g., zipper mechanism 220 or 6220 of storage device 6200) is properly closed, alarm system 300 becomes activated. In this way, it can be ensured that when retention element 6233 is in the locked position it is also under the zipper car.

Optionally, the zipper car may be locked or hidden behind into a lockable panel (not shown) or box (not shown) for preventing the pulling down of the zipper car for opening the garment bag. Optionally, puller 221 may comprise a loop that can be clicked into the recess of the lock mechanism, which can then be latched for form-fittingly securing the loop (and hence the zipper car). Clearly, additional or alternative mechanisms may be envisaged for form-fittingly securing the zipper car to the lock mechanism, when set in the locked configuration.

Activation of alarm system 300 for the respective item storage device may for example be indicated by activation of the respective red LED and deactivation of the corresponding green LED. It is noted that alarm system 300 may only be activated when retention element 6233 is in the locked position. Conversely, by properly causing retention element 6233 to be set in the unlocked position, alarm system 300 may become unarmed.

Further referring now to FIG. 17A, conductive traces 7321 may be embedded in the receptacle body of an item storage device 7200 which may be backpack.

Additional embodiments of storage devices can include suitcases (including hard shell cases), carrier bags, transport cases, transport boxes, purses and/or trolleys, and which can have one or more compartments or storage areas separate from each other and which can be made accessible or inaccessible by suitably opening and closing one or more corresponding fasteners. For instance, properly closing and opening a first and/or second fastener may activate and deactivate the alarm system with respect to the corresponding first and/or second storage area. It is noted that, in some embodiments, a garment bag may have a plurality of compartments that are individually controllable by the alarm system. In some embodiments, a plurality of individual alarm systems may be employed.

Such storage devices may comprise alarm module 400 and power module 450 operably coupled with the electrically conductive traces 7321 to form (e.g., portable) storage systems. Moreover, conductive traces may be embedded in convertible soft tops, a tarpaulin-based and/or any other type of sheet, and operably coupled with alarm module 400. For instance, a car battery of a convertible car may power an alarm system that comprises electrically conductive traces 8321 embedded in a convertible soft top, as well as an alarm module comprised in the car. The alarm system may be configured to detect tearing or cutting of the electrically conductive traces when the car's convertible soft top is deployed in the expanded configuration. In analogy to what has been described herein with respect to item storage device 200, item storage device 7200 can comprise a lock mechanism (not shown) that includes a zipper mechanism 7220 which, when properly closed, activates an alarm system (not shown) of item storage device 7200.

Referring now to FIG. 17B, a tarpaulin of a tent may comprise electrically conductive traces 8321. A solar panel 8900 or any other power source may power the tent's alarm system comprising electrically conductive traces 8321. In analogy to what has been described herein with respect to item storage device 200, item storage device 8200 can comprise a lock mechanism (not shown) that includes a zipper mechanism 8220 which, when properly closed, activates an alarm system (not shown) of item storage device 8200.

Similar patterns may be formed by electrically conductive traces 7321 and 8321 as outlined with respect to conductive traces 321. Moreover, conductive traces 7321 and 8321 may be arranged in a similar manner with respect to the teeth of zipper mechanisms 7220 and 8220, as outlined herein with respect of conductive traces 321 and the teeth of zipper mechanism 220, e.g., as schematically illustrated in FIG. 13. Furthermore, the manufacturing processes outlined herein with respect to item storage device 200 may also be employed for the manufacturing of devices 6200 and 7200.

Additional reference is now made to FIG. 18. A method for using system 100 may for example comprise, as indicated by step 18100, causing electric current to flow in conductive pathways embedded in receptacle 201 enclosing storage area 203.

As indicated by step 18200, the method may comprise, for example, monitoring a parameter relating to the electric current flowing in the conductive pathways.

As indicated by step 18300, the method may comprise, for example, providing, in response to a detected change in the monitored parameter, an output which is indicative of an attempt of unauthorized access to the storage area.

Reference is now made to FIG. 19. In an embodiment, a method of manufacturing receptacle 201 may for example comprise, as indicated by step 19100, interposing an electrically conductive trace between two electrically insulating sheets. Optionally, the electrically conductive trace may be arranged on a trace carrier sheet that is sandwiched between the two electrically insulating sheets. Optionally, the electrically conductive trace may be interposed between the two electrically insulating sheets without the use of a trace carrier sheet.

As indicated by step 19200 the method may comprise applying a fastener device to the electrically insulating sheets.

As indicated by step 19300, the method may include coupling the insulating sheets to form a receptacle comprising a storage area that is encompassed or surrounded by the conductive trace for securely storing items therein and which can be selectively made accessible and closed by opening and closing fastener 220.

For example, one stack of insulating sheets may be coupled to another stack to form the front and back panel of a garment bag (or any other type of receptacle, such as a backpack). In another example, a single stack of insulating sheets may be pre-cut into a desired shape allowing the coupling of their ends into a receptacle of desired shape. It is noted that in some embodiments, steps 19200 and 19300 may be in reverse order.

Optionally, at least two of the three steps 19100-19300 shown in FIG. 19 may be executed in a single manufacturing step using, e.g., additive manufacturing (also: 3D printing).

In some embodiments, the method may comprise interposing another, second electrically conductive trace between two electrically insulating sheets (step 19150 in FIG. 20) so that receptacle 201 comprises a stack of insulating sheets where at least two conductive traces are interposed between three insulating sheets, and the two conductive traces and insulating sheets are overlayed in an alternating manner. Optionally, the method may comprise applying fastener 220 to the stack of sheets. In some embodiments, a stack of insulating sheets with the interposed electrically conductive traces may be manufactured using additive manufacturing.

In some embodiments, some or all components of the item storage devices disclosed herein may be manufactured using additive manufacturing.

In an embodiment, a method of manufacturing receptacle 201 may comprise, for example, providing a first insulating trace carrier sheet. The method may further comprise coupling (e.g., sewing or gluing) an electrically conductive trace such to extend or run, in a first orientation and serpentine-like manner or zigzag pattern, on the first carrier sheet, e.g., such that the electrically conductive trace overlays the first carrier sheet. In an embodiment, the method may further comprise providing another electrically conductive trace to run, in a second orientation and optionally serpentine—like manner or zigzag pattern, on a second carrier sheet. In an embodiment, the method may further comprise interposing the second trace carrier sheet between one of the two insulating sheets and another electrically insulating sheet. The two conductive traces may be electrically insulated from one another. One or more conductive traces may be embedded in the receptacle. In some embodiments, a first pair of electrically conductive traces may be embedded in front panel 204A and, optionally, a second pair of electrically conductive traces may be embedded in back panel 204B.

It is noted that electrically conductive traces may run along and/or within side panel 204C.

In embodiments, a conductive trace may be arranged either on or embedded within a sheet. In some embodiments, a conductive trace can be partially arranged on a sheet (e.g., glued or sewed onto a trace carrier sheet) and partially embedded within a trace carrier sheet.

The above methods of manufacturing may be applicable to any item storage device of any system disclosed herein.

The various features and steps discussed above, as well as other known equivalents for each such feature or step, can be mixed and matched by one of ordinary skill in this art to perform methods in accordance with principles described herein. Although the disclosure has been provided in the context of certain embodiments and examples, it will be understood by those skilled in the art that the disclosure extends beyond the specifically described embodiments to other alternative embodiments and/or uses and obvious modifications and equivalents thereof. Accordingly, the disclosure is not intended to be limited by the specific disclosures of embodiments herein. For example, any computer system can be configured or otherwise programmed to implement a method disclosed herein, and to the extent that a particular digital computer system is configured to implement such a method, it is within the scope and spirit of the disclosure. Once a digital computer system is programmed to perform particular functions pursuant to computer-executable instructions from program software that implements a method disclosed herein, it in effect becomes a special purpose computer particular to an embodiment of the method disclosed herein. The techniques necessary to achieve this are well known to those skilled in the art and thus are not further described herein. The methods and/or processes disclosed herein may be implemented as a computer program product such as, for example, a computer program tangibly embodied in an information carrier, for example, in a non-transitory computer-readable or non-transitory machine-readable storage device and/or in a propagated signal, for execution by or to control the operation of, a data processing apparatus including, for example, one or more programmable processors and/or one or more computers. The terms "non-transitory computer-readable storage device" and "non-transitory machine-readable storage device" encompasses distribution media, intermediate storage media, execution memory of a computer, and any other medium or device capable of storing for later reading by a computer program implementing embodiments of a method disclosed herein. A computer program product can be deployed to be executed on one computer or on multiple computers at one site or distributed across multiple sites and interconnected by a communication network.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

In the discussion, unless otherwise stated, adjectives such as "substantially" and "about" that modify a condition or relationship characteristic of a feature or features of an embodiment of the invention, are to be understood to mean that the condition or characteristic is defined to within tolerances that are acceptable for operation of the embodiment for an application for which it is intended.

It should be noted that the term "item" as used herein refers to any physically tangible, individually distinguishable unit of packaged or unpackaged good or goods. Positional terms such as "upper", "lower" "right", "left", "bottom", "below", "lowered", "low", "top", "above", "elevated", "high", "vertical" and "horizontal" as well as grammatical variations thereof as may be used herein do not necessarily indicate that, for example, a "bottom" component is below a "top" component, or that a component that is "below" is indeed "below" another component or that a component that is "above" is indeed "above" another component as such directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

"Coupled with" means indirectly or directly "coupled with".

It is important to note that the method may include is not limited to those diagrams or to the corresponding descriptions. For example, the method may include additional or even fewer processes or operations in comparison to what is described herein and/or the accompanying figures. In addition, embodiments of the method are not necessarily limited to the chronological order as illustrated and described herein.

It should be understood that where the claims or specification refer to "a" or "an" element or feature, such reference is not to be construed as there being only one of that element. Hence, reference to "an element" or "at least one element" for instance, may also encompass "one or more elements".

Unless otherwise stated, the use of the expression "and/or" between the last two members of a list of options for selection indicates that a selection of one or more of the listed options is appropriate and may be made.

It is noted that the term "perspective view" as used herein may also refer to an "isometric view" and vice versa.

The term "non-transitory" is used to exclude transitory, propagating signals, but to otherwise include any volatile or non-volatile computer memory technology suitable to the application.

It is appreciated that certain features of the invention, which are, for clarity, described in the context of separate embodiments, may also be provided in combination in a single embodiment. Conversely, various features of the invention, which are, for brevity, described in the context of a single embodiment, example and/or option, may also be provided separately or in any suitable subcombination or as suitable in any other described embodiment of the invention. Certain features described in the context of various embodiments are not to be considered essential features of those embodiments, unless the embodiment, example, and/or option is inoperative without those elements. Accordingly, features, structures, characteristics, stages, methods, modules, elements, entities or systems disclosed herein, which are, for clarity, described in the context of separate examples, may also be provided in combination in a single example. Conversely, various features, structures, characteristics, stages, methods, modules, elements, entities or systems disclosed herein, which are, for brevity, described in the context of a single example, may also be provided separately or in any suitable sub-combination.

It is noted that the term "exemplary" is used herein to refer to examples of embodiments and/or implementations, and is not meant to necessarily convey a more-desirable use-case.

In alternative and/or other embodiments, additional, fewer, and/or different elements may be used.

Throughout this application, various embodiments may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include—where applicable—any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

While the invention has been described with respect to a limited number of embodiments, these should not be construed as limitations on the scope of the invention, but rather as exemplifications of some of the embodiments.

What is claimed is:

1. A storage system for securely storing a plurality of garment bags in a publicly accessible area, comprising:

at least one frame structure, wherein the at least one frame structure comprises a plurality of item hanging hardware mechanisms for receiving items for storage, and a plurality of garment bags comprising receptacles that are non-removably coupled, in a suspending manner, from the frame structure, and fasteners for opening and closing the respective receptacles, wherein each one of the fasteners operably cooperates with a lock mechanism of the storage system for selectively securing the fastener in a closed position and for unsecuring the fastener for allowing the fastener to be set from the closed into an open position;

an alarm system that is operably coupled with the plurality of receptacles and, when armed, provides an output responsive to detecting that the structural integrity of the receptacle is compromised; and an output module comprising a light source coupled with the frame structure to indicate to a user which one of the garment bags have an item stored therein and which not, to indicate to the user which of the plurality of item storage devices is available for storing items therein; and wherein the lock mechanism comprises:

a latch; and a safety mechanism that is operably coupled with the alarm system for preventing activation of the alarm system unless a glider for closing the zipper mechanism of the garment bag is properly positioned in a closed position if pulled into a recess of a lock panel of the system;

wherein the safety mechanism is configured to selectively block and unblock passage of the latch from the unlocked to the locked position;

wherein when the glider is pulled into the recess such that the zipper mechanism is properly closed, the safety mechanism unblocks the passage such that the latch is movable from the unlocked to the locked position, thereby form-fittingly securing the glider in the recess and thus preventing unzipping of the zipper mechanism.

2. The storage system of claim 1, wherein the item hanging hardware mechanisms are reversibly extendable out of the frame structure from a stowed into an extended position.

3. The storage system of claim 1, comprising a plurality of frame bodies that are modularly connectable.

4. The storage system of claim 1, wherein the lock mechanism comprises an identification mechanism selected from a group comprising:

mechanical key-based identification;
electronic key-based identification;
passcode-based identification;
biometric-based identification; and
any combination of the aforesaid.

5. The storage system of claim 1, wherein user identification information can be provided onsite to the lock mechanism of the storage system and/or remotely via a mobile computerized end-user device that is associated with a user of the storage system.

6. The storage system of claim 1, wherein the receptacles comprise form-shaping elements.

7. The storage system of claim 6, wherein the form-shaping element comprises an annular polygonal body arranged at the bottom of the receptacle and allowing the receptacle to air out.

8. The storage system of claim 1, wherein the receptacle is a garment bag made of a slack yet tear-resilient material.

9. The storage system of claim 1, wherein the receptacles are displacable in forward direction, or fixedly and non-removably coupled with the frame structure.

10. The storage system of claim 1, wherein the safety mechanism comprises a U-shaped element that is slidably coupled to the lock panel in alignment with the recess of the lock panel such to allow only vertical movement of the U-shaped element.

11. The storage system of claim 10, wherein the safety mechanism is configured such that the when U-shaped element is not properly pulled into the recess, the U-shaped element is by default set in the blocking position in which U-shaped element blocks the passage of the latch from moving from the unlocked to the locked position.

12. The storage system of claim 11, wherein the U-shaped element is by default set in the blocking position through gravitation or by a drive mechanism.

13. The storage system of claim 12, wherein when the U-shaped element is set in the blocking position, it gravitationally rests or is forced to rest against a stopper of the lock panel.

* * * * *